US012281478B2

(12) United States Patent
Erickson

(10) Patent No.: US 12,281,478 B2
(45) Date of Patent: Apr. 22, 2025

(54) RAILING ASSEMBLIES AND METHODS OF INSTALLATION

(71) Applicant: UFP INDUSTRIES, INC., Grand Rapids, MI (US)

(72) Inventor: Tyler Gene Erickson, Ferndale, WA (US)

(73) Assignee: UFP Industries, Inc., Grand Rapids, MI (US)

( * ) Notice: Subject to any disclaimer, the term of this patent is extended or adjusted under 35 U.S.C. 154(b) by 0 days.

(21) Appl. No.: 18/962,858

(22) Filed: Nov. 27, 2024

(65) Prior Publication Data

US 2025/0084644 A1 Mar. 13, 2025

Related U.S. Application Data

(63) Continuation of application No. 18/314,381, filed on May 9, 2023.

(60) Provisional application No. 63/342,227, filed on May 16, 2022.

(51) Int. Cl.
*E04F 11/18* (2006.01)

(52) U.S. Cl.
CPC ..... *E04F 11/1817* (2013.01); *E04F 11/1848* (2013.01); *E04F 2011/1823* (2013.01)

(58) Field of Classification Search
None
See application file for complete search history.

(56) References Cited

U.S. PATENT DOCUMENTS

| | | | | |
|---|---|---|---|---|
| 4,702,459 | A | 10/1987 | Moschner | |
| 8,814,145 | B2 | 8/2014 | Herman | |
| 9,133,645 | B2 | 9/2015 | Toglia | |
| 9,790,707 | B2 | 10/2017 | Burt | |
| 2005/0207838 | A1* | 9/2005 | Striebel | E04F 11/1834 403/368 |
| 2008/0191185 | A1 | 8/2008 | Barnes | |
| 2013/0020546 | A1 | 1/2013 | Truckner | |
| 2013/0328004 | A1 | 12/2013 | Truckner | |
| 2019/0186154 | A1 | 6/2019 | Williams | |
| 2020/0378131 | A1 | 12/2020 | Rucker | |
| 2024/0110381 | A1 | 4/2024 | Schneider | |

FOREIGN PATENT DOCUMENTS

| | | | |
|---|---|---|---|
| CN | 114016686 | A | 2/2022 |
| CN | 215889434 | U | 2/2022 |
| CN | 216340549 | U | 4/2022 |
| DE | 448756 | C | 8/1927 |
| DE | 202008004301 | U1 | 6/2008 |
| GB | 2272006 | A | 5/1994 |
| GB | 2373260 | B | 9/2002 |
| KR | 950003938 | A1 | 2/1995 |
| KR | 100802500 | B1 | 2/2008 |
| KR | 100981409 | B1 | 9/2010 |
| KR | 200467788 | Y1 | 7/2013 |

(Continued)

*Primary Examiner* — Daniel J Wiley
(74) *Attorney, Agent, or Firm* — McGarry Bair PC

(57) ABSTRACT

A railing system includes at least one post and at least one rod defining a first distal end and a second distal end. The railing system further includes at least one connector assembly. The at least one connector assembly operably couples one of the first distal end or the second distal end of the at least one rod to the at least one post.

19 Claims, 21 Drawing Sheets

(56) References Cited

FOREIGN PATENT DOCUMENTS

| | | | |
|---|---|---|---|
| KR | 101798638 | B1 | 11/2017 |
| KR | 102011241 | B1 | 8/2019 |
| KR | 102186454 | B1 | 12/2020 |

* cited by examiner

RAILING ASSEMBLIES AND METHODS OF INSTALLATION

CROSS-REFERENCE TO RELATED APPLICATION(S)

This application is a continuation of U.S. patent application Ser. No. 18/314,381, filed May 9, 2023, which, in turn, claims the benefit of U.S. Provisional Patent Application No. 63/342,227, filed on May 16, 2022, all of which are incorporated herein by reference in their entirety.

BACKGROUND

Fencing is usually constructed from posts and rails. Typically, a number of spaced apart posts are coupled to a surface like concrete floors or wooden decks, the posts extending vertically therefrom. Rails extend horizontally between the posts.

DETAILED DESCRIPTION

Aspects of the present disclosure relate to a railing assembly or railing system and connectors, such as for use in a railing or with decking, that allows for both faster assembly and easier assembly. Aspects of the present disclosure, by way of non-limiting example, allow for the construction of a metal railing with reduced or eliminated hardware. The ability for easy, tool-free connection points in the framing system makes it advantageous. It will be understood that, while the remainder of the present disclosure discusses the aspects of this disclosure with reference to a railing system and connectors for use in a fence or railing application, that the frame and connector can have much broader applicability and provide similar benefits thereto.

Figure 1:
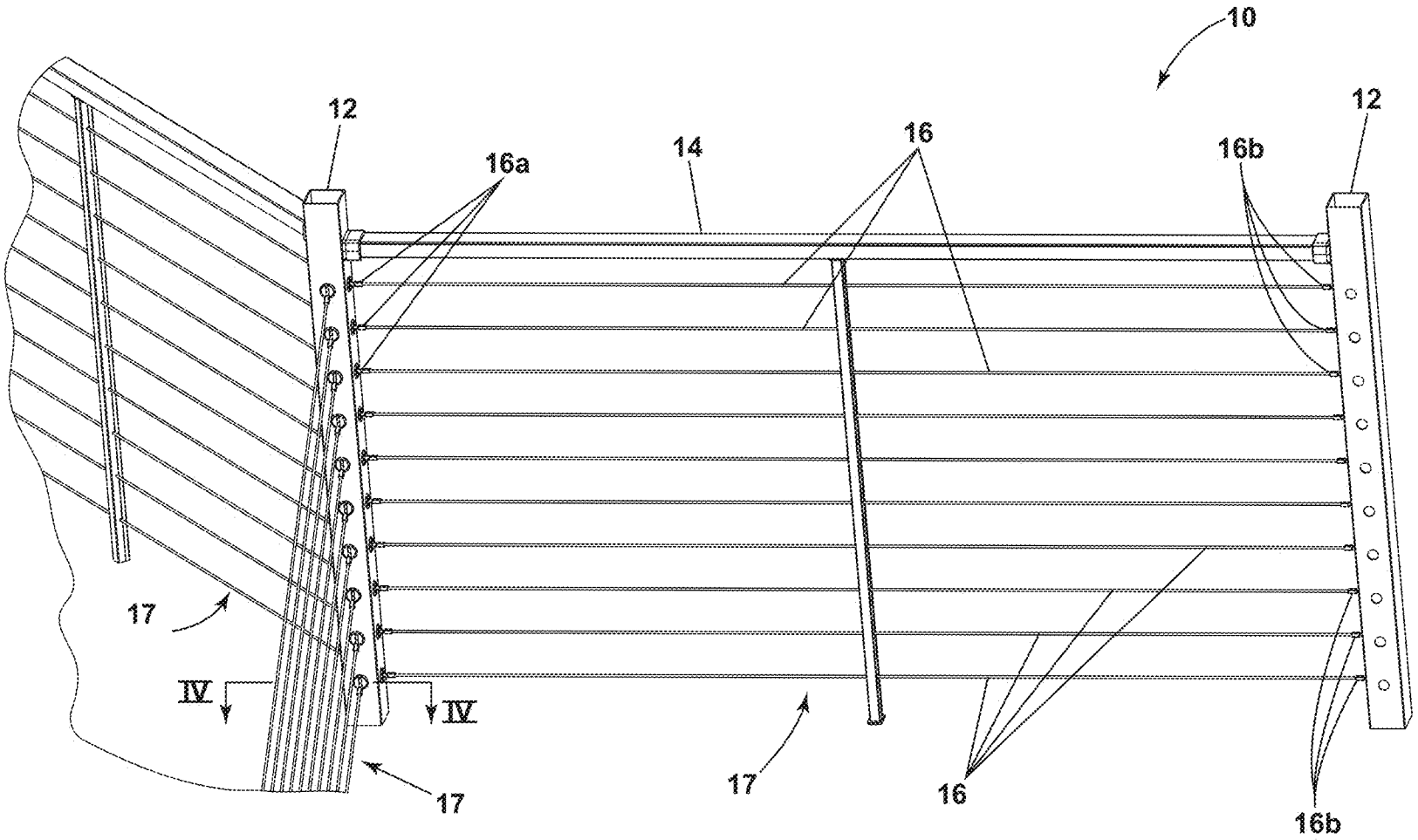
FIG. 1 is a partial view of a railing system including a post, a rail, and a plurality of rods, according to an aspect of the present disclosure.

FIG. 1 illustrates a railing system 10 according to an aspect of the present disclosure. The railing system 10 comprises at least one post 12, an upper rail 14, and a plurality of rods 16. In the illustrated example, the at least one post 12 is illustrated as including a set of posts 12, specifically including two posts 12. The set of posts 12 are generally vertically extending or vertically oriented. The set of posts 12 can include any suitable type of posts 12 and may be made from a variety of materials, including, but not limited to, plastic, composite, steel, iron, aluminum, wood, fiberglass, other metals or some combination of these materials. The set of posts 12 may be made by extruding the material having the profile shown in FIG. 1, and then cutting the extrusion to the desired height for the posts 12.

The upper rail 14 extends from the at least one post 12 perpendicularly. More specifically, the upper rail 14 spans generally horizontally between the set of two posts 12.

Each rod 16 of the plurality of rods 16 extends between two respective, opposing distal ends, illustrated herein as a first distal end 16*a* and a second distal end 16*b*. Each distal end 16*a*, 16*b* is coupled to a corresponding portion of one of the posts 12. There can be any number of one or more rods 16 in the plurality of rods 16. At least a portion of the plurality of rods 16 can be equally or non-equally spaced along the at least one post 12 in a vertical direction. At least one of the plurality of rods 16 can extend parallel or non-parallel to another one or more of the rods 16. At least one of the plurality of rods 16 can extend parallel or non-parallel to the upper rail 14. At least one of the plurality of rods 16 can extend perpendicularly or non-perpendicularly with respect to the at least one post 12. The plurality of rods 16 can be made of a variety of materials, including, but not limited to, composite, steel, stainless steel, iron, aluminum, other metals, or some combination of these materials. In a preferred aspect, each of the plurality of rods 16 can include a steel rod with continuous threads along its length. While the plurality of rods 16 in the figures have been shown as smooth, it will be understood that the rods 16 can be threaded along their entire length.

The railing system 10 can include multiple pluralities of rods 16. In other words, the railing system 10 can include at least one grouping 17 of rods 16, with each grouping 17 of rods 16 including a respective plurality of rods 16. As illustrated, there are three groupings 17 of rods 16. In the illustrated example, one post 12 can be coupled to each plurality of rods 16 of all three groupings 17 of rods 16. A single grouping 17 of rods 16 is defined by a single plurality of rods 16 that extend between two posts 12.

Figure 2:
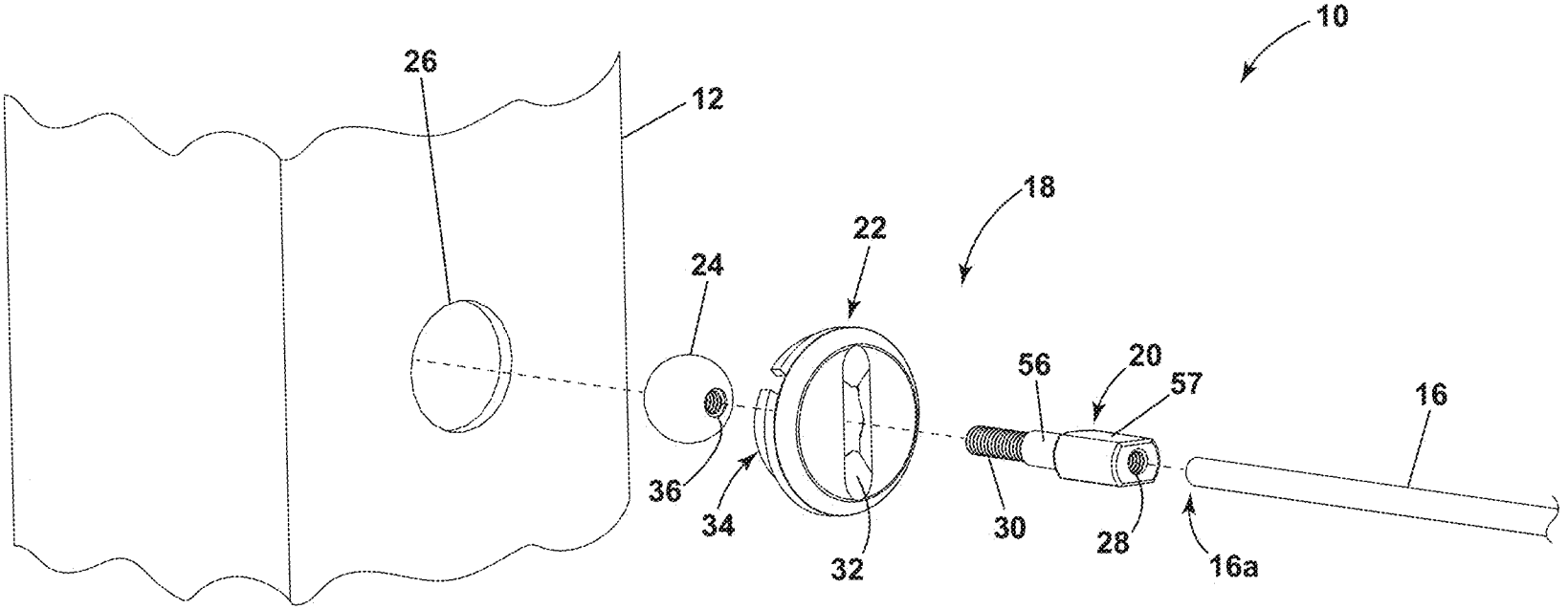
FIG. 2 is an enlarged, exploded perspective view of a portion of the railing system of FIG. 1, including a portion of the post, a threaded ball, a socket, a threaded connector, and a portion of a rod section.

FIG. 2 is an enlarged, exploded perspective view of a portion of the railing system 10 of FIG. 1. A connector assembly 18 can operably couple a first distal end 16*a* of a first rod 16 of the plurality of rods 16 to a respective portion of the at least one post 12. Further, it will be understood that the railing system 10 can include a first connector assembly 18 movably coupling one of the first distal end 16*a* or the second distal end 16*b* to one post 12, while a second connector assembly 18 movably couples the other of the first distal end 16*a* or the second distal end 16*b* to a second post 12. The connector assembly 18 includes a threaded connector 20, a socket 22, and a ball 24.

The threaded connector 20 includes a main body 57 and a leg 56 extending from the main body 57. A first threaded section 28 can be formed within the main body 57, such that the first threaded section 28 forms a female receptacle. In other words, a threaded female receptacle, defining the first threaded section 28, is formed within the main body 57 of the threaded connector 20. At least a portion of the leg 56 can include a second threaded section 30. As illustrated, only a portion of the leg 56 includes the second threaded section 30. In this manner, the leg 56 forms a threaded male fitting. The first threaded section 28 and the second threaded section 30 can each include a respective thread. The thread of the first threaded section 28 can be in the same or opposite direction as the thread of the second threaded section 30. It is contemplated that the first threaded section 28 will be a right handed thread and the second threaded section 30 will be a left handed thread.

The socket 22 can include a channel 32 and a seat 34. The channel 32 extends through the socket 22 and is coupled to a portion of the seat 34. The seat 34 is sized to accept the ball 24 such that the ball 24 cannot be removed from, or otherwise fall out of, the seat 34. The ball 24, however, is free to move within the seat 34, such as that the ball 24 is rotatably or pivotably received within the seat 34, while also at least partially retained within the seat 34. At least a portion of the socket 22 is made of an elastic material. In one example, the seat 34 does not create a force on the ball 24, which allows the socket 22 to be more easily manufactured via injection molding. However, as a non-limiting example, the seat 34 is made of an elastic material, such that it can flex outward to accept the ball 24 and subsequently revert back towards its original shape to create a sealing or coupling force on the ball 24. By way of non-limiting example, the socket 22 can be an injection molded, unitarily formed, monolithic piece.

The ball 24 includes a third threaded section 36. The third threaded section 36 is formed within the ball 24 and may extend through the ball 24 from opposing sides. In other words, a threaded receptacle, defining the third threaded section 36, is formed through the ball 24. The ball 24, as illustrated, is a sphere. It will be appreciated, however, that the ball 24 can be a variety of shapes.

Figure 3:
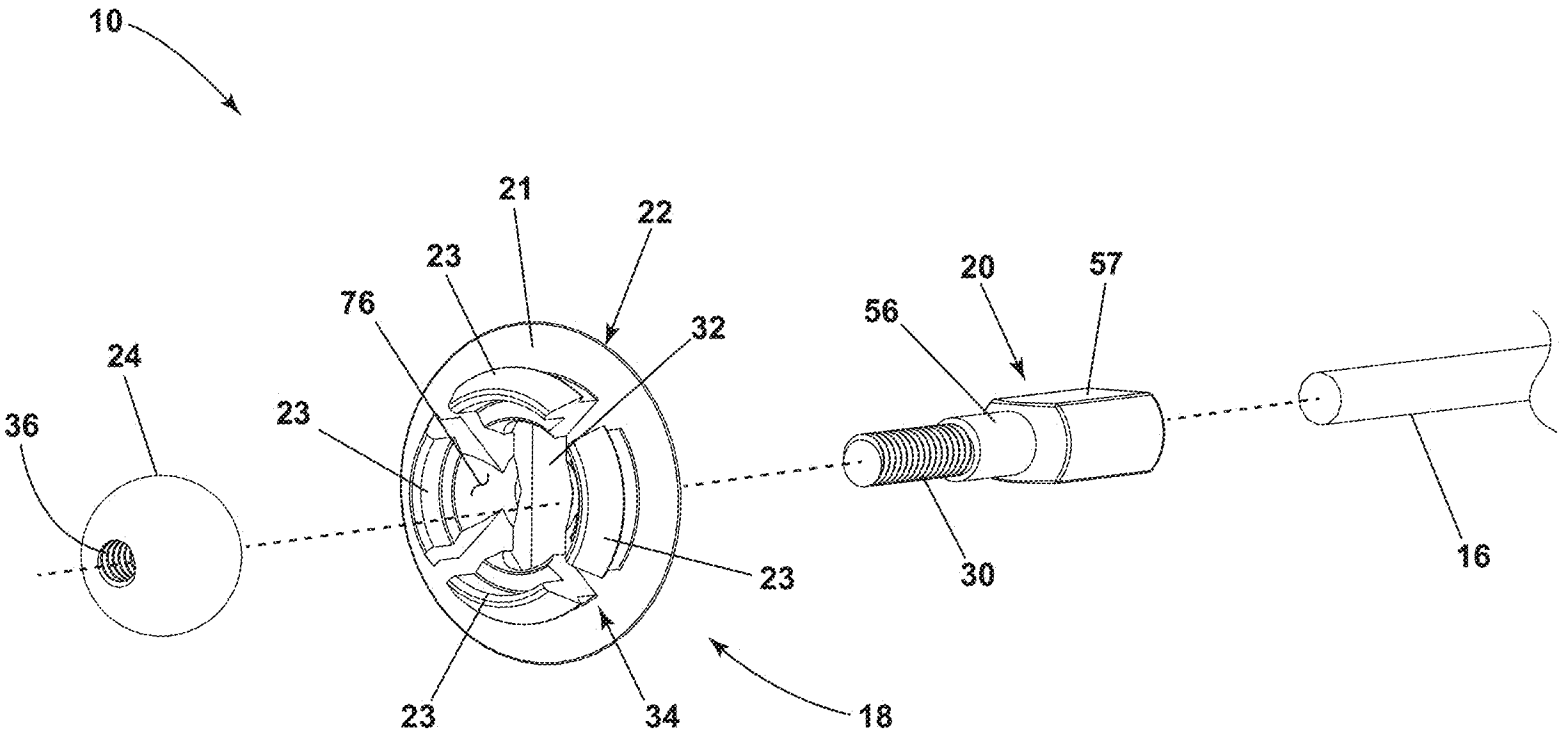
FIG. 3 is another enlarged, exploded perspective view of the threaded ball, the socket, the threaded connector, and the portion of the rod section of FIG. 2.

FIG. 3 is another exploded, perspective view of the connector assembly 18. As can be more easily seen, the socket 22 includes a void 76. As a non-limiting example, the seat 34 includes the void 76. The void 76 is sized to accept the ball 24. The channel 32 opens to, or is otherwise directly coupled to, at least a corresponding portion of the void 76 of the seat 34. The channel 32 is sized to accept the leg 56, such that the leg 56 can be inserted through the channel 32. The channel 32 extends through the socket 22 and is coupled to the void 76 defined by the seat 34. The socket 22 includes a face 21 and tabs 23 that project from the face 21 to define the void 76.

To begin assembly, at least a portion of the leg 56, such as at least a portion of the second threaded section 30, can extend through the channel 32 and into the void 76. The second threaded section 30 of the connector 20 is threaded into the third threaded section 36 of the ball 24 while the ball 24 is received within the seat 34.

Figure 4:
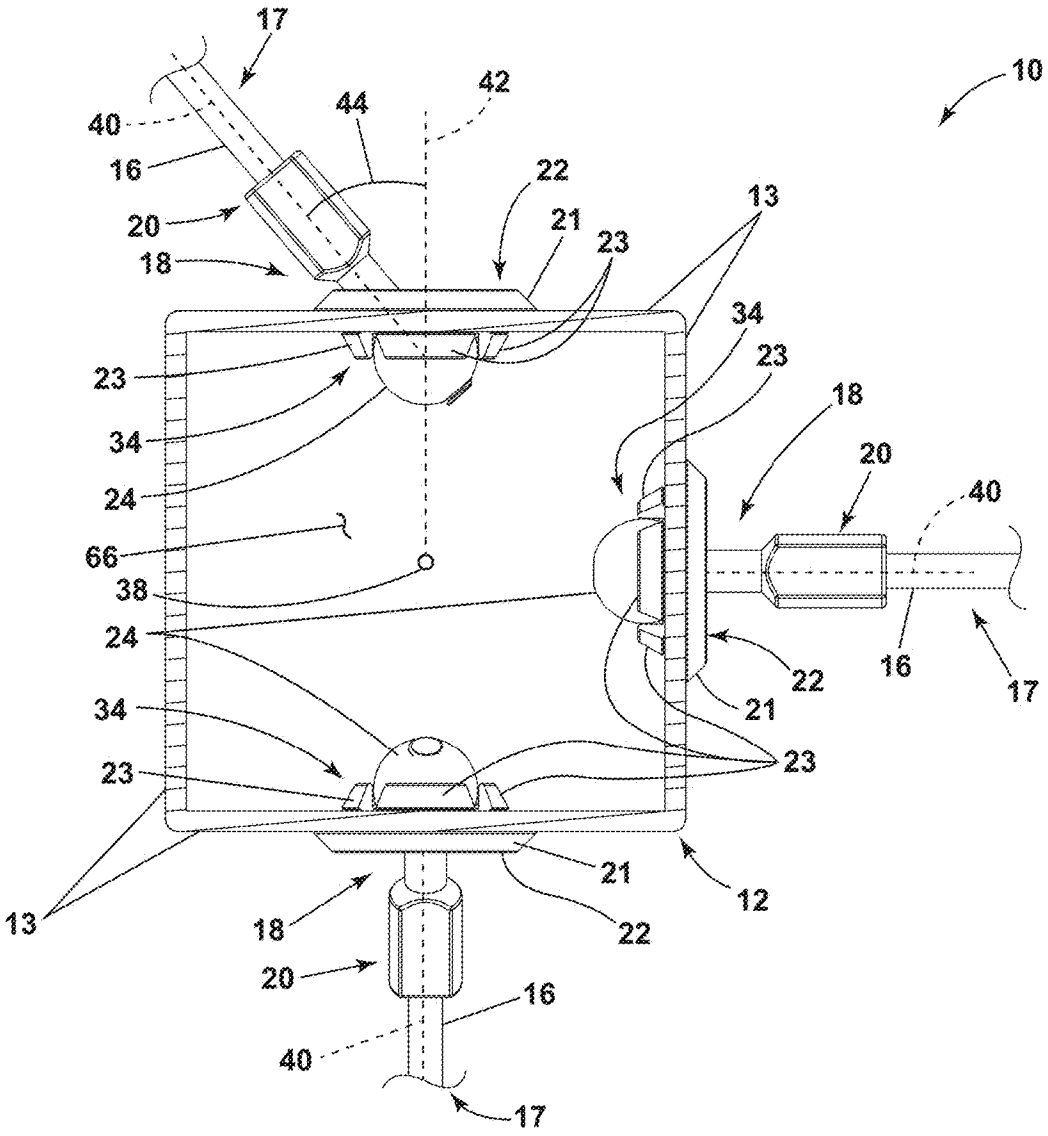
FIG. 4 is a top, cross-sectional view of a portion of the railing system, including the post, of FIG. 1 and taken along line IV-IV of FIG. 1.

The at least one post 12 (FIG. 2) can include an opening 26 (FIG. 2) in which at least a portion of the connector assembly 18 is inserted through. More specifically, the seat 34 can be inserted into the opening 26 of the at least one post 12 and tabs 23 can flex inward such that the seat 34 can extend through a wall 13 (FIG. 4) of the at least one post 12 and into an interior 66 (FIG. 4) of the at least one post 12. Once inserted, the seat 34, and hence the socket 22, cannot be easily removed from the opening 26. The face 21 of the socket 22 seats against the post 12 and the tabs 23 can clip onto the inside of the post 12 wall 13 (FIG. 4). The tabs 23 have cutout reliefs in order to be installed from the outside pressing in.

The rod 16 can be secured to the connector assembly 18 such that the rod 16 is secured to or otherwise movably coupled to the at least one post 12 through the connector assembly 18. The rod 16 can be threaded into the first threaded section 28 either before or after the socket 22 is received in the opening 26.

When assembled, the threaded connector 20 directly couples to the rod 16 at a first end defined by the main body 57 and the first threaded section 28. The threaded connector 20 extends through the socket 22 and is directly coupled to the ball 24 at a second end, opposite the first end, and defined by the leg 56 and the second threaded section 30. The ball 24 is fit within the socket 22. The connector assembly 18 is inserted through the opening 26 such that only a portion of the socket 22 and the entire ball 24 are provided within the interior 66 (FIG. 4) of the at least one post 12.

As mentioned above, at least a portion of the rod 16 is threaded. As a non-limiting example, an entire length of the rod 16 is threaded. The thread of the rod 16 can be threaded into the first threaded section 28 such that the rod 16 can be selectively coupled to the threaded connector 20. The third threaded section 36 is reverse threaded with respect to the second threaded section 30. The second threaded section 30 is selectively coupled to the third threaded section 36. As such, movement of the threaded connector 20 when the second threaded section 30 is received within the third threaded section 36 will not result in the thread between the second threaded section 30 and the third threaded section 36 from becoming undone while the rod 16 is being threaded into the first threaded section 28.

While not illustrated, it will be appreciated that a decorative insert can be provided over at least a portion of the connector assembly 18 and the rod 16. As a non-limiting example, the decorative insert (not shown) can be provided over the threaded connector 20 and a portion of the rod 16. The decorative insert (not shown) can be used to shield or otherwise cover up the respective portions of the railing system 10 that it overlays.

FIG. 4 is a top-down, cross-sectional view of a portion of the railing system 10 of FIG. 1, including the post 12 as seen from sight line IV-IV of FIG. 1. The at least one post 12 extends in the vertical direction along a longitudinal body axis or a centerline 38. The at least one post 12 is hollow such that outer walls 13 of the at least one post 12 define the interior 66 of the at least one post 12. The at least one post 12 includes a rectangular cross-section when viewed along a horizontal plane with respect to the centerline 38 that intersects the at least one post 12. It will be appreciated that the cross-section of the at least one post 12 can be a variety of cross-sections, such as, but not limited to, a triangular cross-section, a circular cross-section, or any other suitable cross-section.

At least a portion of the connector assembly 18 extends into the interior 66. As illustrated, the socket 22 extends through the wall 13 of the at least one post 12 such that the seat 34 lays within the interior 66. The socket 22 is sized such that it lays flush against an interior and an exterior portion of the respective wall 13 of the post 12 that it extends through when the socket 22 is inserted through the respective opening 26 of the wall 13. The ball 24 is provided at least partially within the interior 66.

As illustrated, the at least one post 12 is operably coupled to three groupings 17 of rods 16 (illustrated by rods 16 extending from three of the four walls 13 of the at least one post 12). Each rod 16 extends along a respective direction indicated by a rod centerline 40. As the rod 16 is operably coupled to the threaded connector 20, and indirectly coupled to the ball 24, the rod centerline 40 is illustrated to extend through the rod 16 and through at least a portion of the connector assembly 18.

Each rod centerline 40 can extend in any suitable direction. As a non-limiting example, at least a portion of the rod centerlines 40 can extend parallel or non-parallel to a vertical plane 42 extending along the centerline 38 and intersecting the respective rod centerline 40. As a non-limiting example, the vertical plane 42 can intersect one of the rod centerlines 40, as illustrated. A horizontal angle 44 is formed between the respective rod centerline 40 and the vertical plane 42. The horizontal angle 44 is any suitable angle, such as, by way of non-limiting example, less than or equal to 45 degrees and greater than or equal to −45 degrees.

Figure 5:
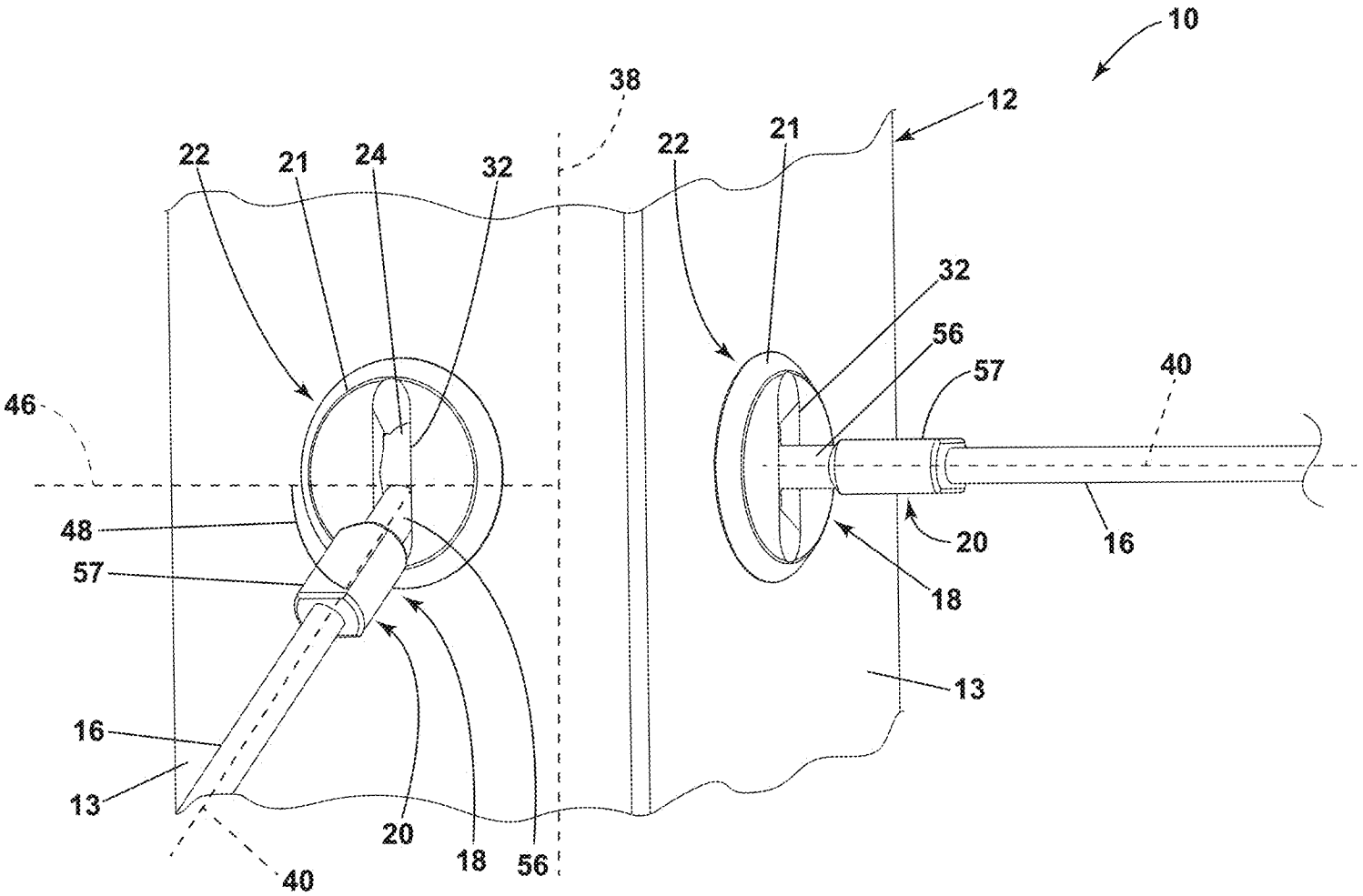
FIG. 5 is an enlarged perspective view of a portion of the railing system of FIG. 1.

FIG. 5 is a perspective view of a portion of the railing system 10 of FIG. 1. At least a portion of at least one of the rod centerlines 40 can extend parallel or non-parallel to a horizontal plane 46 intersecting the centerline 38 and the respective rod centerline 40. As a non-limiting example, a vertical angle 48 is formed between the horizontal plane 46 intersecting the centerline 38 and the respective rod centerline 40. The vertical angle 48 is any suitable angle, such as, by way of non-limiting example, less than or equal to 45 degrees and greater than or equal to −45 degrees.

It is contemplated that the rods 16 can be dynamically moved along a single plane of movement to define a respective angle between the single plane of movement and the centerline 38. This angle is not static once the connector assembly 18 is installed with the post 12. In other words, the rod 16 can be moved along the single plane of movement to any desired angle relative to the post 12. It is contemplated that the channel 32 can be positioned or oriented, when inserting the connector assembly 18 through the opening 26, such that the respective rod 16 connected to the connector assembly 18 is allowed 90 degrees of movement along the single plane defined by the orientation of the channel 32. The single plane can be a vertical plane (e.g., the vertical plane 42), a horizontal plane (e.g., the horizontal plane 46), or a combination of both the horizontal plane and the vertical plane. In this way, the rotational or pivotal movement of the ball 24 within the seat 34 can be thought of as operably and movably coupling the rod 16 for rotatable or pivotal movement relative to the at least one post 12 in the plane of movement defined by the orientation of the channel 32. The positioning or orientation of the connector assembly 18, including the channel 32, such that the connector assembly 18 lays along a single plane of movement, and the movement of the rod 16 along the single plane of movement is collectively referred to herein as the dynamic installation of the rod 16 relative to the post 12.

The dynamic installation of the rod 16 greatly reduces the burden of installation. For example, a user or someone installing the railing system 10 does not need to perfectly match up the height or vertical position of the rod 16 and two adjacent posts 12 prior to coupling the rod 16 to the two posts 12. Instead, a user can select the plane of movement that they want the rod 16 to move along. Once selected, the user has 90 degrees of movement along said plane of movement to match up a distal end 16*a*, 16*b* of the rod 16 to the other post 12.

Further, the dynamic installation of the rods 16 allows for more complex railing systems 10 or assemblies. For example, in an instance where the railing system 10 is being installed along a slope (e.g., one post 12 is higher than the other post 12), the user of the railing system 10 can easily position the rods 16 along the angle needed to connect the two posts 12 as each rod 16 has free movement along a respective plane of movement once the connector assembly 18 is inserted into one of the two posts 12.

Figure 6:
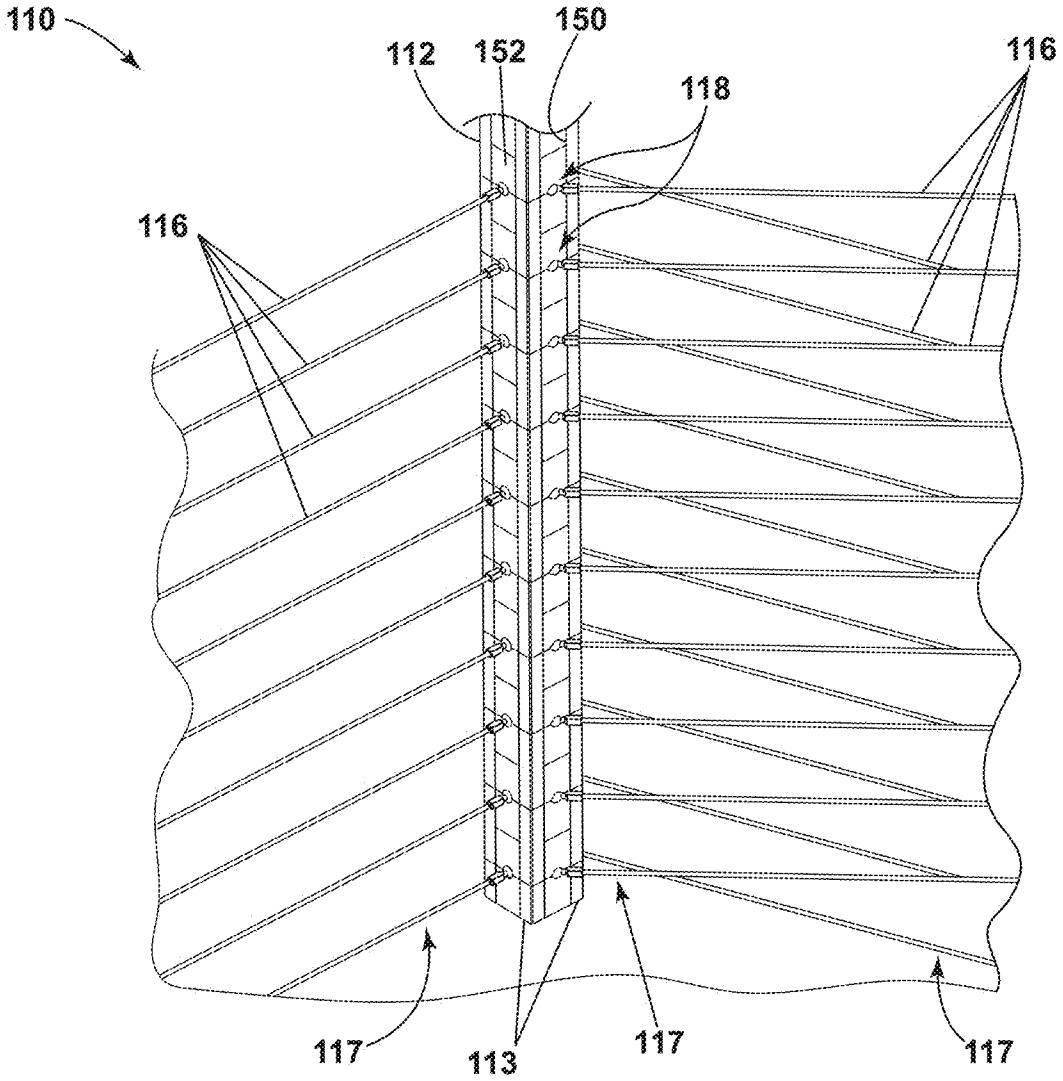
FIG. 6 is a partial perspective view of another example of a railing system, according to another aspect of the present disclosure.

By way of additional non-limiting example, FIG. 6 illustrates another example of a railing system 110. The railing system 110 is similar to the railing system 10 previously described and therefore, like parts will be identified with like numerals increased by 100, with it being understood that the description of the like parts of the railing system 10 applies to the railing system 110, unless otherwise noted.

The railing system 110 includes at least one post 112 and a plurality of rods 116. Each rod 116 can be connected to the at least one post 112 through a connector assembly 118. The railing system 110 can also include at least one grouping 117 of rods 116, with each single grouping 117 of rods 116 defined by a single plurality of rods 116 that extend between two posts 112. Further, while an upper rail 14 is not illustrated within the railing system 110 as shown in FIG. 6, it will be understood that this is done for simplicity of the figure and that the railing system 110 can include at least one upper rail 14, as described with respect to the railing system 10.

One difference from the railing system 10 is that the at least one post 112 of the railing system 110 includes channels 150 formed therein. The channels 150 have been illustrated as being included on each face or wall 113 of the at least one post 112; however, this need not be the case. Further still, the channels 150 have been illustrated as being included along an entire length or height of the post 112, although this also need not be the case. In the instance where the post 112 is an extruded metal post, it will be understood that the channels 150 will run the length or height of the post 112. During assembly, the rod 116 can be connected to the connector assembly 118, which can then be slid into the respective channel 150.

Figure 7:
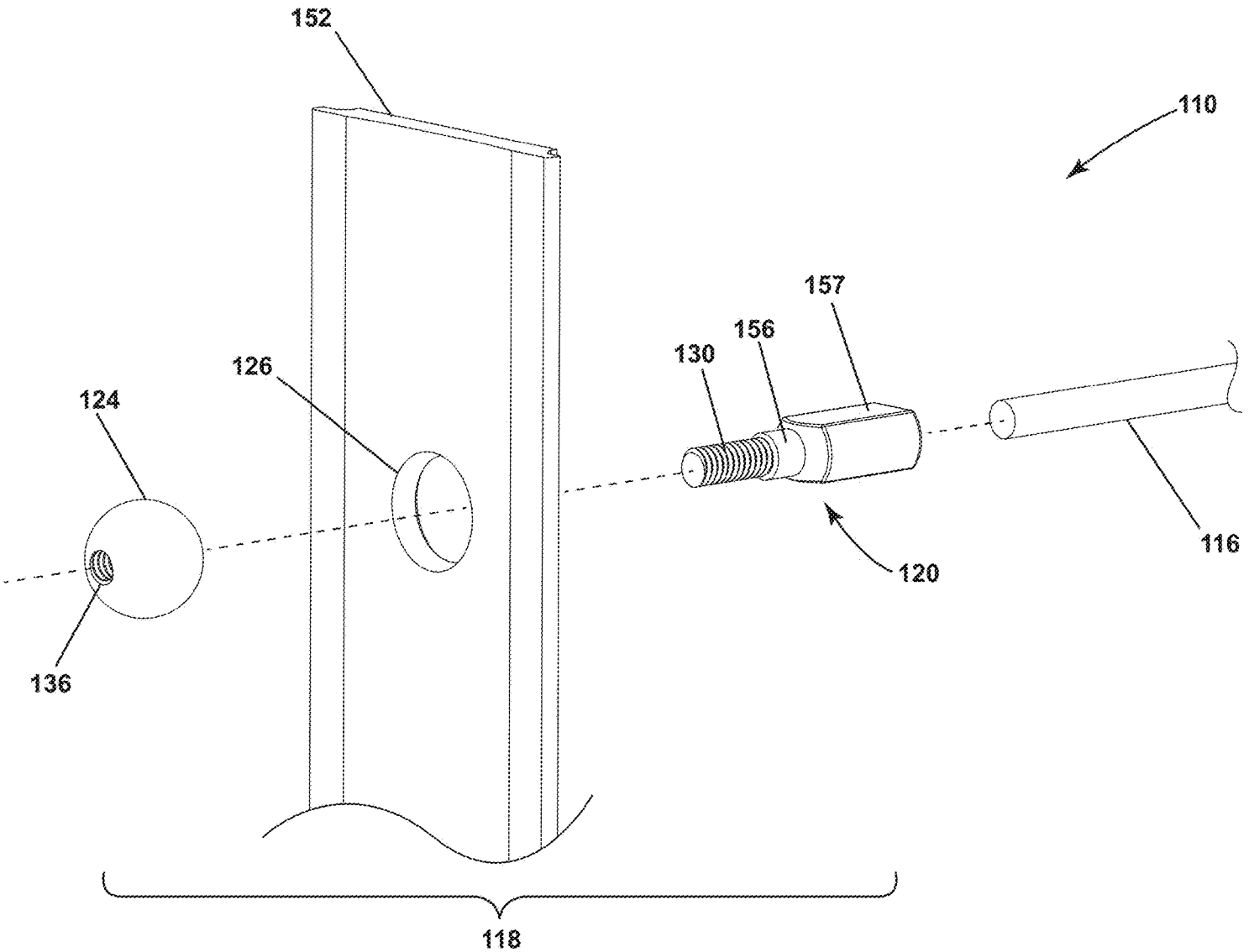
FIG. 7 is an enlarged and exploded perspective view of a portion of the railing system of FIG. 6, including a portion of a rod and a connector assembly.
Figure 8:
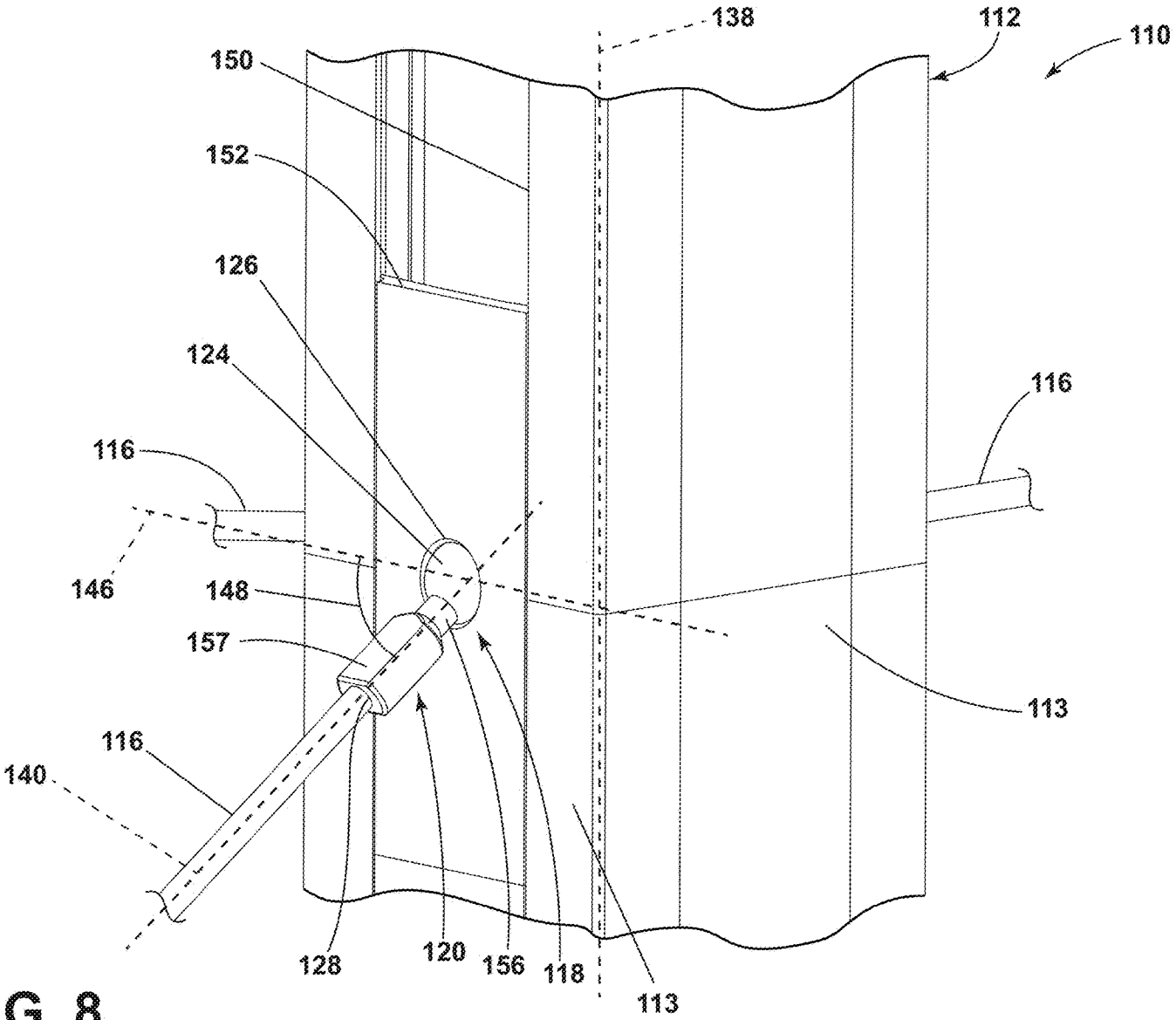
FIG. 8 is an enlarged and assembled perspective view of a portion of the railing system of FIG. 6, with the rod in an angled position relative to a post.

FIG. 7 is an enlarged and exploded perspective view of the connector assembly 118 of FIG. 6. The connector assembly 118, like the connector assembly 18, includes a threaded connector 120 and a ball 124. The threaded connector 120 includes a main body 157 with a first threaded section 128 (FIG. 8) formed therein, and a leg 156 extending from the main body 157 with a second threaded section 130 formed along at least a portion of the leg 156. A third threaded section 136 is formed within the ball 124. The rod 116 includes a threaded portion (not shown) that is threaded into the first threaded section 128 (FIG. 8). The second threaded section 130 is threaded into the third threaded section 136.

The connector assembly 118 differs from the connector assembly 18 as the connector assembly 118 includes a plate 152. The plate 152 is sized to be selectively received within the channel 150. The plate 152 includes an opening 126 similar to the opening 26 of the post 12. The ball 124 rests on a first side of the plate 152 within the opening 126, such that at least a portion of the ball 124 is positioned within an interior (not shown) of the post 112 when the ball 124 is retained within the opening 126. In other words, the opening 126 acts as the seat 34 and can be thought of as forming at least a portion of the seat 34. The ball 124 is able to move along multiple planes of movement when received within the opening 126, such that the connector assembly 118 movably couples the rod 116 to the at least one post 112. As such, the rod 116 can move along multiple planes of movement when connected to the at least one post 112, such as that the rod 116 is pivotable relative to the at least one post 112 in at least a vertical and a horizontal plane of movement, via the connector assembly 118, rather than just a single plane of movement like the rod 16.

FIG. 8 is an enlarged and assembled perspective view of a portion of the at least one post 112 and the connector assembly 118 of the railing system 110 of FIG. 6. As illustrated, the connector assembly 118 is received within the channel 150 by positioning the plate 152 within the channel 150.

The rod 116 extends along a rod centerline 140. An angle 148 is formed between the rod centerline 140 and a horizontal plane 146 perpendicular to a centerline 138 of the at least one post 112 and intersecting the rod centerline 140.

The rod 116 and the threaded connector 120 are free to move within or relative to the opening 126 via movement of the ball 124. In other words, the rod 116 and the threaded connector 120 do not have to move along a single plane of movement, but can instead move along multiple planes of movement. This, in turn, allows for an increased case of installation with respect to the railing system 10. The rod 116 is free to move radially and circumferentially with respect to the horizontal plane 146. This radial and circumferential movement gives increased dynamic installation of the rod 116.

Figure 9:
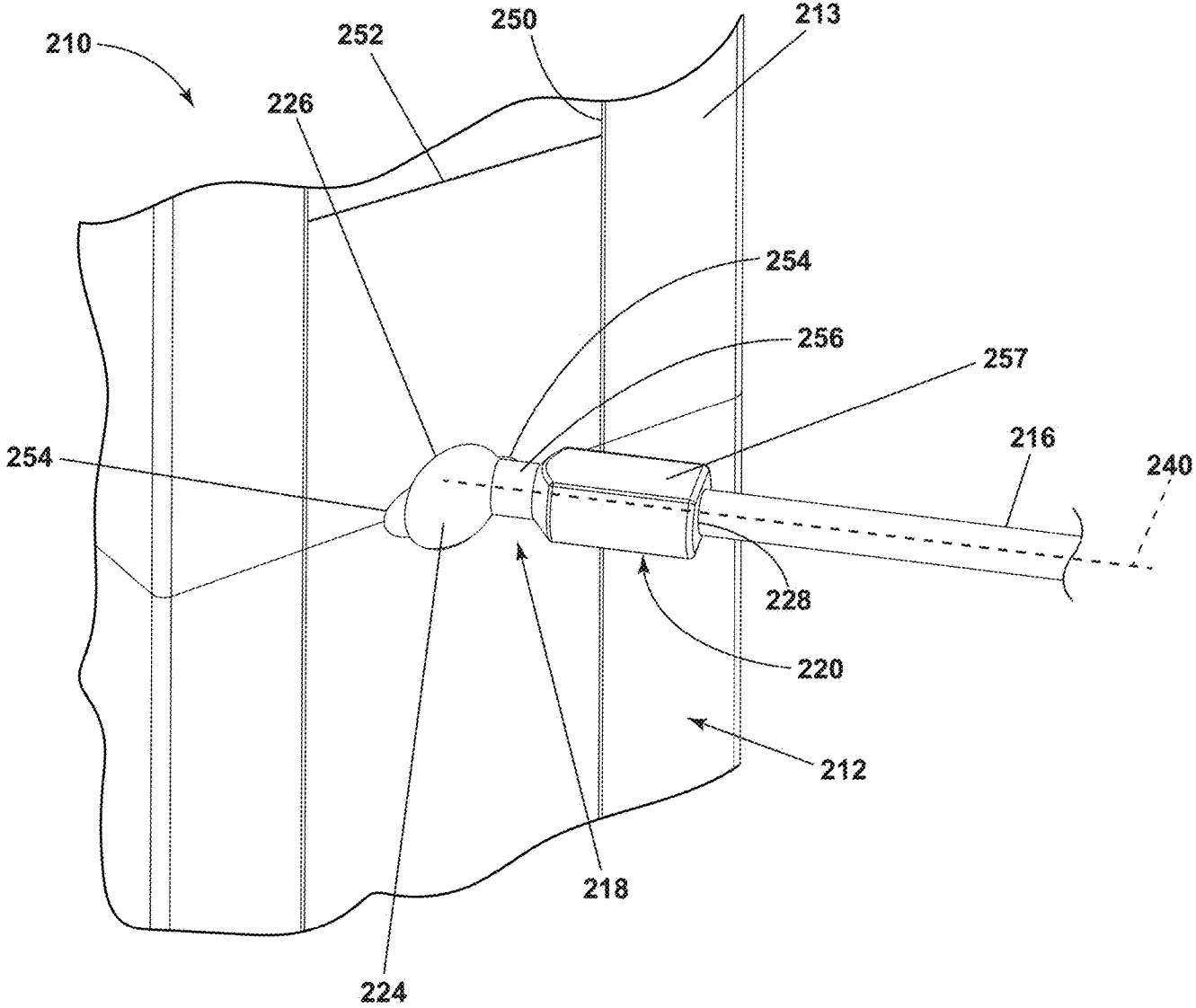
FIG. 9 is an enlarged perspective view of a portion of another example of a railing system, similar to the railing system of FIG. 6, according to another aspect of the present disclosure.

FIG. 9 is an enlarged perspective view of another exemplary railing system 210 suitable for use as the railing system 10 of FIG. 1. The railing system 210 is similar to the railing systems 10, 110 as previously described, and, therefore, like parts will be identified with like numerals increased to the 200 series, with it being understood that the description of the like parts of the railing systems 10, 110 applies to the railing system 210, unless otherwise noted.

The railing system 210 includes at least one post 212 defined by a plurality of walls 213. At least one channel 250 is formed within a portion of the at least one post 212. A connector assembly 218 operably coupled to a rod 216 can be slid into the channel 250 to operably couple the rod 216 to the at least one post 212. The connector assembly 218 includes a threaded connector 220 having a main body 257, within which a first threaded section 228 is formed, and a leg 256, a plate 252 sized to slide into, within, and out of the channel 250, and a ball 224 received within an opening 226 of the plate 252. The rod 216 is defined by a rod centerline 240.

The connector assembly 218 is similar to the connector assembly 118 as the connector assembly 218 allows for similar movement of the rod 216 as described with respect to the connector assembly 118. The connector assembly 218 differs from the connector assembly 118 as the plate 252 includes at least one notch 254 formed along a portion of the opening 226. As illustrated, the opening 226 includes two notches 254 formed 180 degrees apart on the opening 226. The at least one notch 254 is sized to accept at least a portion of the connector assembly 218. As a non-limiting example, the at least one notch 254 is sized to accept the leg 256 of the threaded connector 220.

The at least one notch 254 allows for increased angle of the rod 216 up to −45 to 45 degrees relative to the plate 252. Without the notch 254, the rod 216 is limited to movement between −40 to 40 degrees relative to the plate 252. Vertical stair angles do not require 45 degrees of angle, while some horizontal angle applications do, so it can be particularly advantageous for the at least one notch 254 to be positioned at a portion of the opening 226 that allows for additional degrees of horizontal movement of the rod 216.

Figure 10:
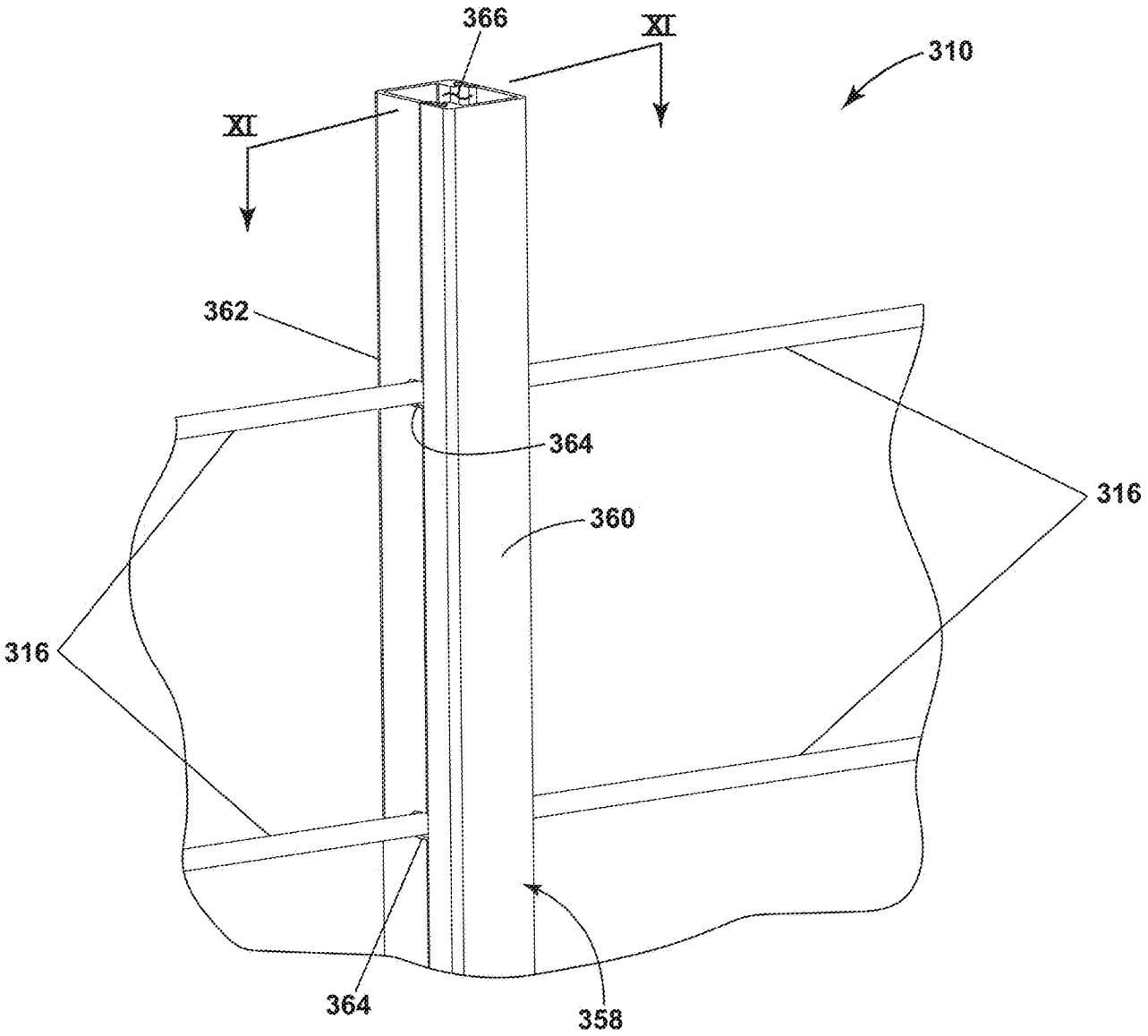
FIG. 10 is a perspective view of a portion of another example of a railing system according to another aspect of the present disclosure and including a portion of a support that can be utilized with any of the railing systems in FIGS. 1, 6, 9, and 10.

FIG. 10 is a perspective view of a portion of another example of a railing system 310, according to another aspect of the present disclosure, and including a portion of an example of a support 358. While the support 358 is illustrated within the railing system 310, it will be understood that the support 358 is also suitable for use with any of the other railing systems 10, 110, 210 previously described. For ease of description, the railing system 310 is similar to the railing systems 10, 110, 210 as previously described, and, therefore, like parts will be identified with like numerals increased to the 300 series, with it being understood that the description of the like parts of the railing systems 10, 110, 210 applies to the railing system 310, unless otherwise noted.

The railing system 310 includes a plurality of rods 316 extending between two respective posts (not illustrated), as described previously with respect to the railing systems 10, 110, 210.

The support 358 is provided along the plurality of rods 316 in between the two posts (not shown) to provide additional structural support for the rods 316. The support 358 can include at least a first frame segment 360 and a second frame segment 362. The first frame segment 360 is operatively coupled to the second frame segment 362, such that the first frame segment 360 and the second frame segment 362 can be collectively thought of as forming a modular frame of the support 358. The support 358 is hollow such that an interior 366 of the support 358 is formed by the first and second frame segments 360, 362.

In the illustrated example, at least a portion of the first frame segment 360 and a corresponding portion of the second frame segment 362 form at least one frame opening 364. As a non-limiting example, the first frame segment 360 can define a first portion of the frame opening 364, while the second frame segment 362 can define a second portion or remaining portion of the frame opening 364. Alternatively, one of the first frame segment 360 or the second frame segment 362 can define an entirety of the frame opening 364. It is contemplated that there can be any number of two or more frame openings 364. The total number of frame openings 364 can be twice the total number of rods 316 within the plurality of rods 316. It is contemplated that opposing sides of the support 358 each include a respective frame opening 364, such that the support 358 includes two opposing and generally vertically aligned frame openings 364 at a given vertical height on the support 358. The frame openings 364 are sized to accept or otherwise fit around a respective portion of a corresponding portion of the respective rod 316. As there are two aligned frame openings 364 spaced from one another about the interior 366, each rod 316 can pass through the respective two aligned frame openings 364 and the interior 366. In other words, each rod 316 can pass through the support 358 via the frame openings 364.

During assembly, the support 358 can be initially separated, such that the first frame segment 360 is not coupled to the second frame segment 362. The first frame segment 360 can then be coupled to the second frame segment 362 through a variety of suitable coupling methods, such as, but not limited to, sliding, hooking, bolting, welding, adhesives, or the like. Each rod 316 of the plurality of rods 316 can either be fed through the support 358 or the support 358 can be fit around the plurality of rods 316 by aligning the frame openings 364 with the plurality of rods 316 prior to coupling the first frame segment 360 to the second frame segment 362.

Figure 11:
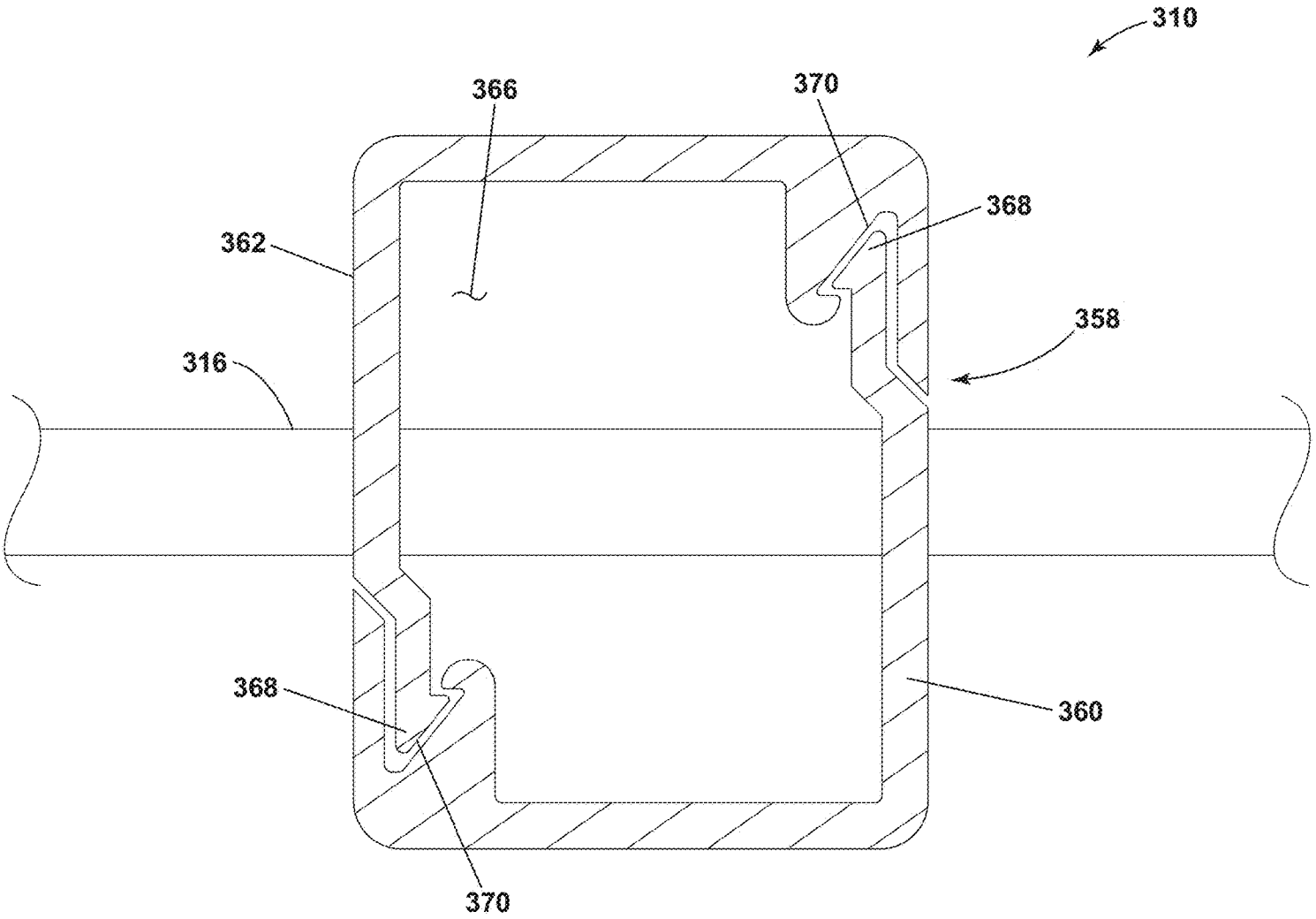
FIG. 11 is a top, cross-sectional view of a portion of the railing system, including the support, of FIG. 10 and taken along line XI-XI of FIG. 10.

FIG. 11 is a top-down, cross-sectional view of a portion of the railing system 310 of FIG. 10, including the support 358 as seen from sight line XI-XI of FIG. 10. The support 358 includes the first frame segment 360 and the second frame segment 362. The first frame segment 360 and the second frame segment 362 can each extend between a respective first distal end including a hook 368 and a respective second distal end including a receiver 370. The hook 368 of the first frame segment 360 corresponds to the receiver 370 of the second frame segment 362 and vice-versa. The hook 368 of one of the first frame segment 360 or the second frame segment 362 forms a joint with the receiver 370 of the other of the first frame segment 360 or the second frame segment 362. The joint formed by the hook 368 and the corresponding receiver 370 can be used to retain the first frame segment 360 to the second frame segment 362.

During assembly of the support 358, the hook 368 of the first frame segment 360 can be aligned with the receiver 370 of the second frame segment 362, and vice versa. The first frame segment 360 and the second frame segment 362 can then be snapped together or otherwise slid into one another, thus creating the assembled support 358, as illustrated.

Figure 12:
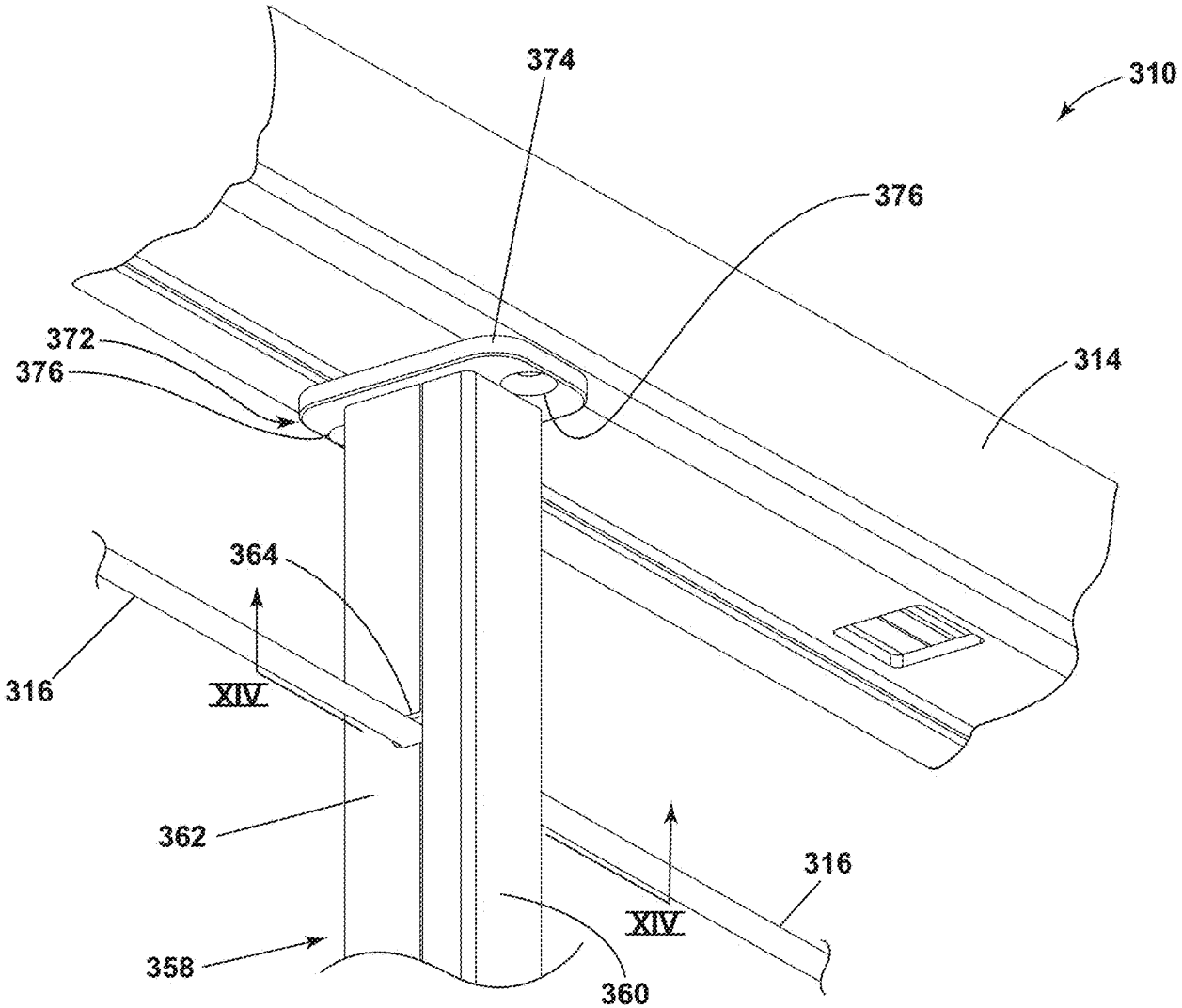
FIG. 12 is a bottom perspective view of a portion of the railing system of FIG. 10, including the support, having a mounting assembly, and a rail, similar to the rail in the railing system of FIG. 1, according to another aspect of the present disclosure.

FIG. 12 is a bottom-up, perspective view of a portion of the railing system 310 of FIG. 10, including the support 358. As illustrated, the support 358 is operably coupled to an upper rail 314 of the railing system 310, which can be thought of as being similar to the upper rail 14 of the railing system 10. The support 358 can further be utilized to attach the railing system 310 to a ground or support surface upon which the railing system 310 is installed, such as a deck surface.

The support 358 further includes a mounting assembly 372 which operatively couples a portion, such as an upper end, of the support 358 to the upper rail 314. The mounting assembly 372 includes at least a mounting bracket 374 and a mount 376. The mounting bracket 374 can lay substantially flush against a lower surface or portion of the upper rail 314 and align the mount 376 with a corresponding portion (e.g., a threaded hole, not shown) of the upper rail 314. The mount 376, as illustrated, is a through hole. While not illustrated, the mount 376 can include a bolt or a screw, or other suitable type of fastener, that is fed through the through hole and secured to the upper rail 314. The mount 376, in turn, secures the mounting assembly 372, and hence the support 358, to the upper rail 314. The mount 376 can be any suitable mount 376. As a non-limiting example, the mount 376 can be, but is not limited to, a bolt assembly, a screw assembly, a clamp, a weld, an adhesive, or the like.

Figure 13:
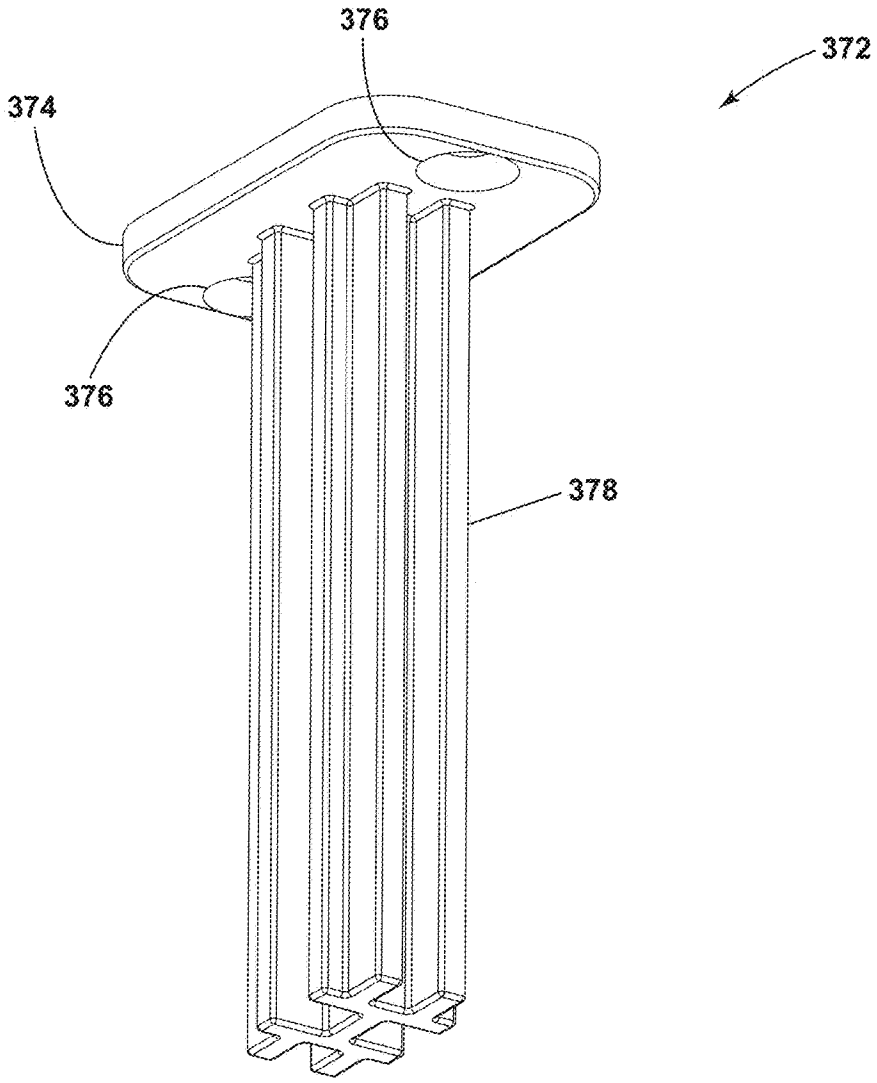
FIG. 13 is a bottom perspective view of the mounting assembly of FIG. 12.

FIG. 13 is a bottom-up perspective view of the mounting assembly 372 of FIG. 12 removed from the railing system 310 of FIG. 12.

The mounting assembly 372 includes a projection 378 that extends downwardly from the bracket 374, and inwardly toward and within the support 358. The projection 378 is sized to fit within the interior 366 of the support 358 and to directly confront at least an interior portion or surface of the first frame segment 360 and/or the second frame segment 362. As such, the projection 378 is used to form a joint or a coupling between the mounting assembly 372 and the remainder of the support 358. It will be appreciated, however, that the mounting assembly 372 can be mounted to the remainder of the support 358 through a variety of suitable methods, such as, but not limited to, welding, adhesives, clamps, screws, or the like. As a non-limiting example, the mounting assembly 372 can be formed without the projection 378 and instead be welded to, or otherwise integrally formed with, the remainder of the support 358.

Figure 14:
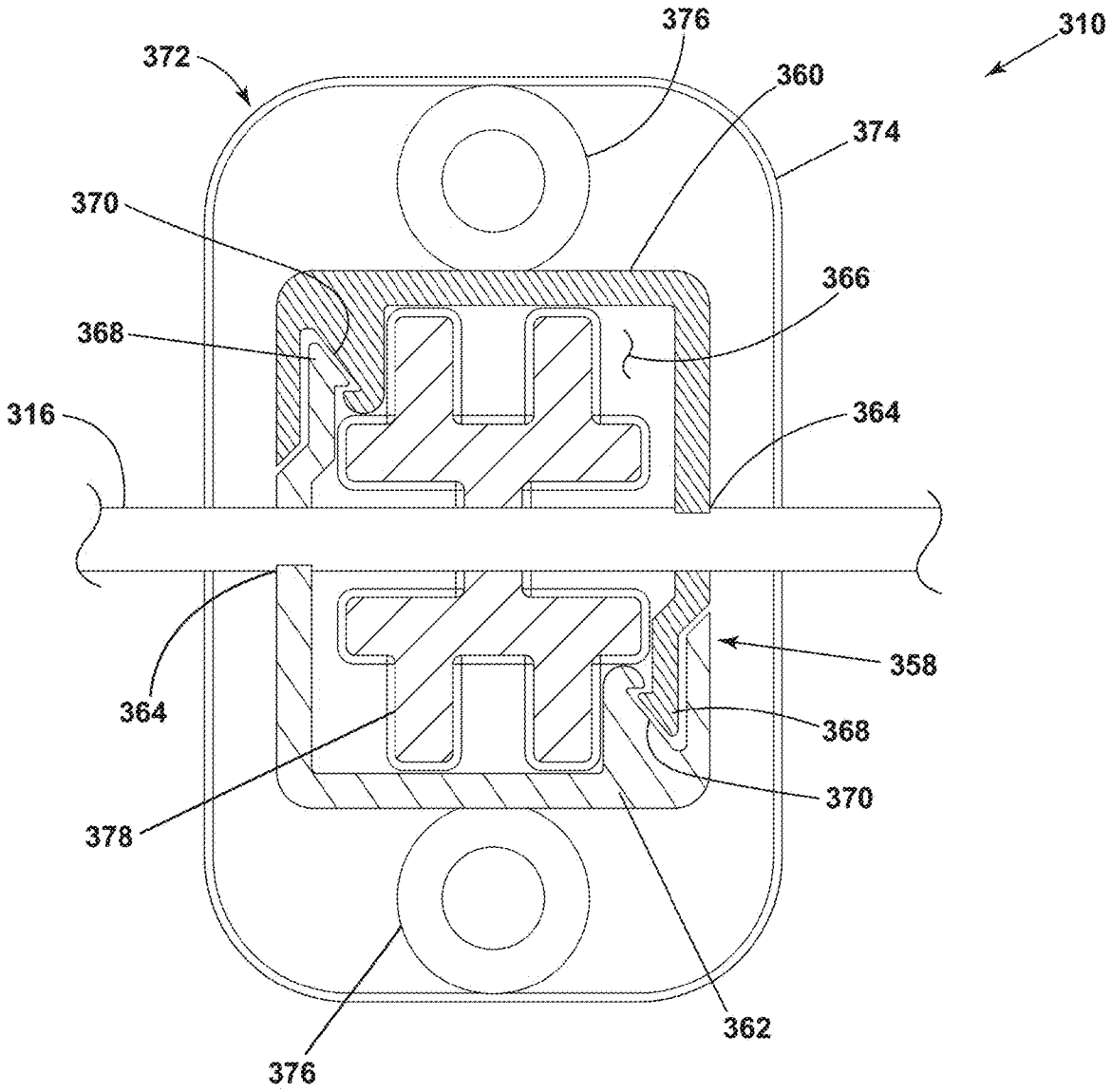
FIG. 14 is a bottom, cross-sectional view of a portion of the railing system of FIG. 12, including the support and the mounting assembly, and with the rail removed, taken along line XIV-XIV of FIG. 12.

FIG. 14 is a bottom-up cross-sectional view of a portion of the railing system 310 of FIG. 12, with the upper rail 314 (FIG. 12) removed, and showing the mounting assembly 372 received within a portion of the support 358, as seen from sight line XIV-XIV of FIG. 12, to illustrate an interface between the mounting assembly 372 and the support 358. As illustrated, the projection 378 extends into the interior 366 and contacts at least a portion of an interior portion or surface of one or both of the first frame segment 360 and the second frame segment 362. The projection 378 terminates above the position of the frame openings 364, prior to the projection 378 contacting the rod 316.

The support 358 is used to provide additional support to the railing system 310. The support 358 limits lateral movement of the railing system 310 by creating a rigid attachment point positioned between the two posts 12, 112, 212. As a non-limiting example, the support 358 is used to support a portion of the plurality of rods 316 between the two posts 12, 112, 212. The support 358 is used to limit the forces experienced along the width of the plurality of rods 316, such as if an external force were to be applied, such as downwardly or upwardly, to the plurality of rods 316. This, in turn, creates a more rigid structure of the railing system 310 that is not as susceptible to bending or flexing due to the application of external forces on the plurality of rods 316. The mounting assembly 372 provides further rigidity or robustness to the railing system 310 by operatively coupling the support 358 to the upper rail 314 (FIG. 12). This, in turn, supports the upper rail 314 (FIG. 12).

Figure 15:
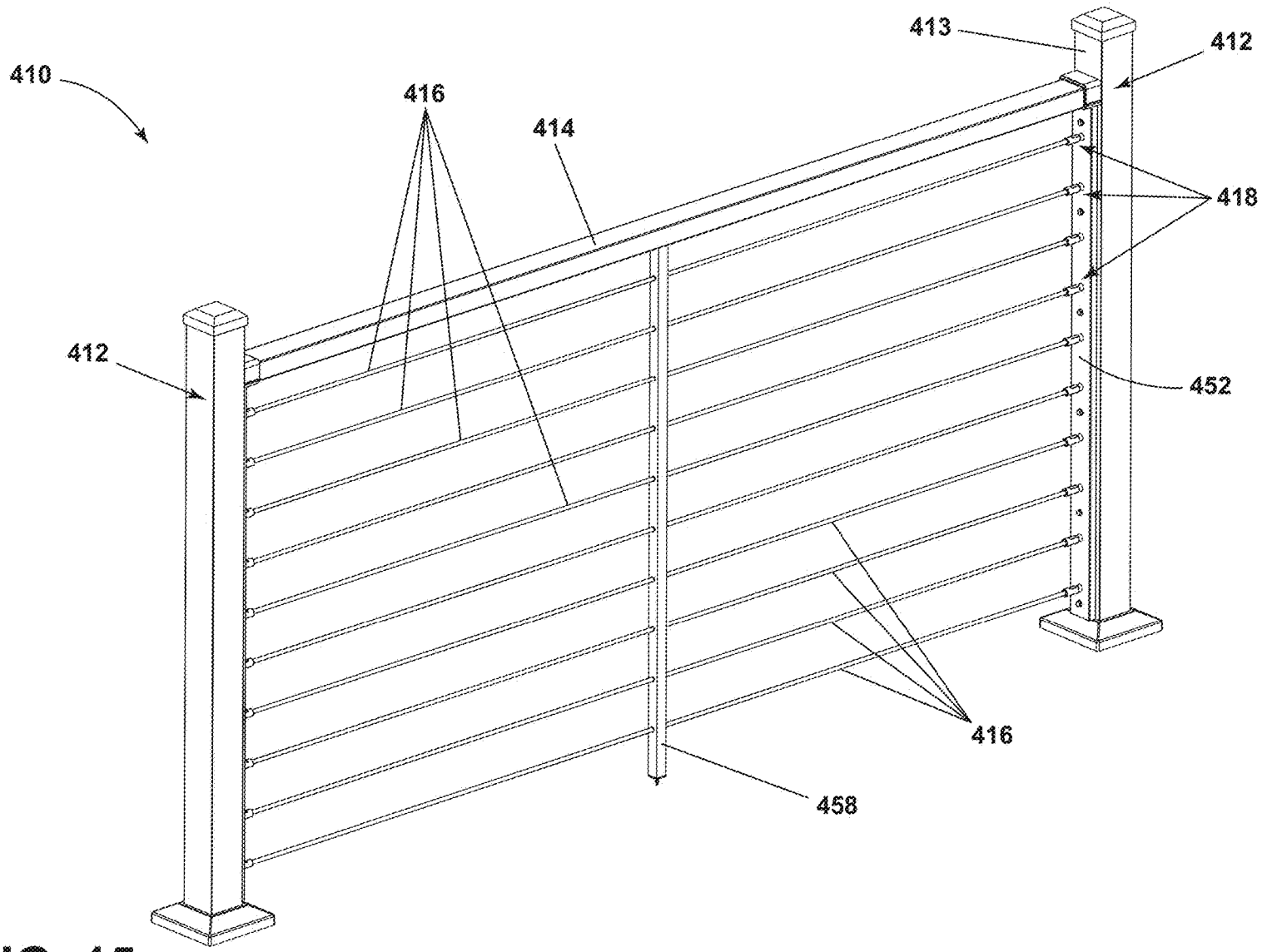
FIG. 15 is a perspective view of a portion of another example of a railing system according to another aspect of the present disclosure, and including a post, a rail, and a plurality of rods.

Turning now to FIG. 15, a portion of another example of a railing system 410 is illustrated, according to another aspect of the present disclosure. The railing system 410 is similar to the railing systems 10, 110, 210, 310; therefore, like parts will be identified with like numerals in the 400 series, with it being understood that the description of the like parts of the railing systems 10, 110, 210, 310 applies to the railing system 410, unless otherwise noted.

The railing system 410 includes at least one post 412, illustrated herein as a set of two posts 412, an upper rail 414, and a plurality of rods 416. Each rod 416 can be connected to the at least one post 412 through a connector assembly 418. The railing system 410 further includes another example of a support 458 provided along the plurality of rods 416 in between the two posts 412 to provide additional structural support for the rods 416.

The railing system 410 is similar to the railing system 110 in that the connector assembly 418 includes a plate 452. However, while the post 112 of the railing system 110 includes channels 150 within which the plate 152 is selectively received and recessed, the plate 452 of the connector assembly 418 is instead coupled to the post 412. In non-limiting examples, the plate 452 extends outwardly from the post 412. As better illustrated in FIG. 16, in one non-limiting example, the plate 452 extends outwardly from a wall 413 of the post 412 that faces the rods 416, such that the plate 452 extends from the wall 413 toward the rods 416. Further, while the railing system 110 was illustrated as including a plurality of plates 152, with one plate 152 corresponding to each rod 116, the plate 452 of the railing system 410 is instead illustrated as a single plate 452 extending along a greater length or height of the post 412. By way of non-limiting example, this can include a majority of the length or height of the post 412. Further still, the plate 452 can be coextensive in height with the vertical position of all of the rods 416 in the plurality of rods 416. It is also contemplated that the plate 452 can extend along an entire length or height of the post 412. During assembly of the railing system 410, each of the rods 416 can be coupled to the plate 452, which can then be attached to the post 412. However, as an alternative, any number of plates 452 can be included along a length or height of the post 412, including two or more, as desired.

Figure 16:
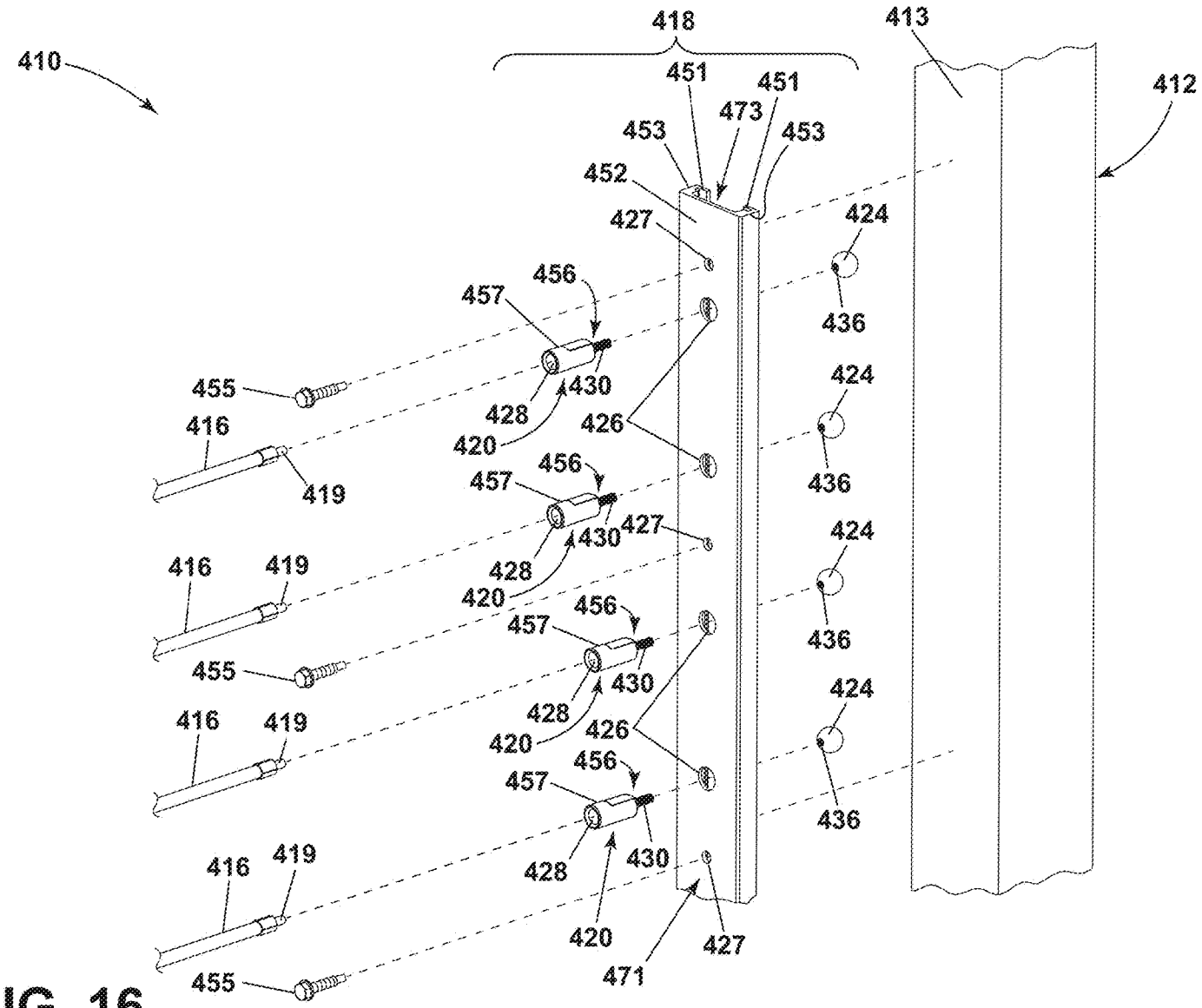
FIG. 16 is an enlarged and exploded perspective view of a portion of the railing system of FIG. 15, including a portion of at least one rod and at least one connector assembly.

Still referring to FIG. 16, the exploded view better illustrates the structure of the plate 452. The plate 452 defines a plurality of openings 426 spaced apart vertically along the length or height of the plate 452. The plate 452 can include any suitable number of openings 426, such as defining an opening 426 corresponding to each of the rods 416, or each of the rods 416 along its corresponding placement. While the openings 426 are illustrated as being evenly vertically spaced on the plate 452, it will be understood that the openings 426 can be spaced apart by any suitable distance, including that some of the openings 426 are evenly spaced apart, while others of the openings 426 may be spaced apart by a different or varying distance. This may be commensurate with the spacing and placement of the rods 416.

The plate 452 includes a first side 471 and a second side 473, the second side 473 opposite from the first side 471. The first side 471 can be commensurate with a front side of the plate 452 and the second side 473 can be commensurate with a back side of the plate 452. A pair of spaced, opposing side walls 453 extend rearwardly from the back side, or the second side 473, of the plate 452. The pair of spaced opposing side walls 453 extend away from the rods 416 and toward the post 412. Each of the opposing side walls 453 further comprise a foot or a flange, illustrated herein as a rear edge 451 of the side walls 453. The rear edges 451 of the side walls 453 are positioned to directly abut or confront the wall 413 of the post 412. While the rear edges 451 are illustrated herein as extending laterally inwardly from the side walls 453 and generally parallel to the plate 452, it will be understood that the rear edges 451 could also extend laterally outwardly from the side walls 453, and still generally parallel to the plate 452. Further still, it will be understood that such rear edges 451 are optional. The side walls 453 can have any suitable width such that the width of the side walls 453 is sufficiently spaced from the post 412 to accommodate at least a portion of a diameter of a ball 424. While the side walls 453 are illustrated as being coextensive in height with the plate 452, it will also be understood that the side walls 453 can extend along only a portion of the height of the plate 452, and/or the side walls 453 can be discontinuous or provided in segments along the height of the plate 452.

The plate 452 further defines a plurality of fastener openings 427 spaced apart vertically along the length or height of the plate 452. The plate 452 can include any suitable number of fastener openings 427, such as defining at least two fastener openings 427 spaced apart at opposite ends of the length or height of the plate 452 for coupling the plate 452 to the wall 413 of the post 412. The fastener openings 427 can be evenly or unevenly vertically spaced on the plate 452 and can be spaced apart by any suitable distance, which may be the same or different between different adjacent fastener openings 427. Each of the fastener openings 427 is configured to receive a fastener 455, such that the plate 452 is provided with at least one fastener 455 and the plate 452 can be coupled to the wall 413 of the post 412 by the at least one fastener 455. The at least one fastener 455 can be any suitable type of fastener 455, non-limiting examples of which include a tack, a screw, a bolt, or the like.

Each connector assembly 418 further includes a threaded connector 420 and the ball 424. The threaded connector 420 includes a main body 457 with a first threaded section 428 formed therein, and a leg 456 extending from the main body 457 with a second threaded section 430 formed along at least a portion of the leg 456. A third threaded section 436 is formed within the ball 424. Each of the rods 416 includes a threaded portion 419 that is adapted to be threaded into the first threaded section 428. The second threaded section 430 is adapted to be threaded into the third threaded section 436. Each of the balls 424 can be positioned at least partially at a rear side of the plate 452, such as by being positioned at least partially within the width of the side walls 453, and within one of the openings 426, such that the openings 426 act as and can be thought of as forming at least a portion of the seat 34 of the connector assembly 18 for the railing system 10. Each of the balls 424 is freely rotatably received within one of the openings 426, such that the balls 424 are able to move along multiple planes of movement when received within the openings 426. In turn, each of the rods 416 can likewise move along multiple planes of movement when connected to the at least one post 412 via the connector assembly 418, similarly to the connector assemblies 118, 218, rather than just a single plane of movement defined by the orientation of the channel 32 of the connector assembly 18, like the rods 16.

Figure 17:
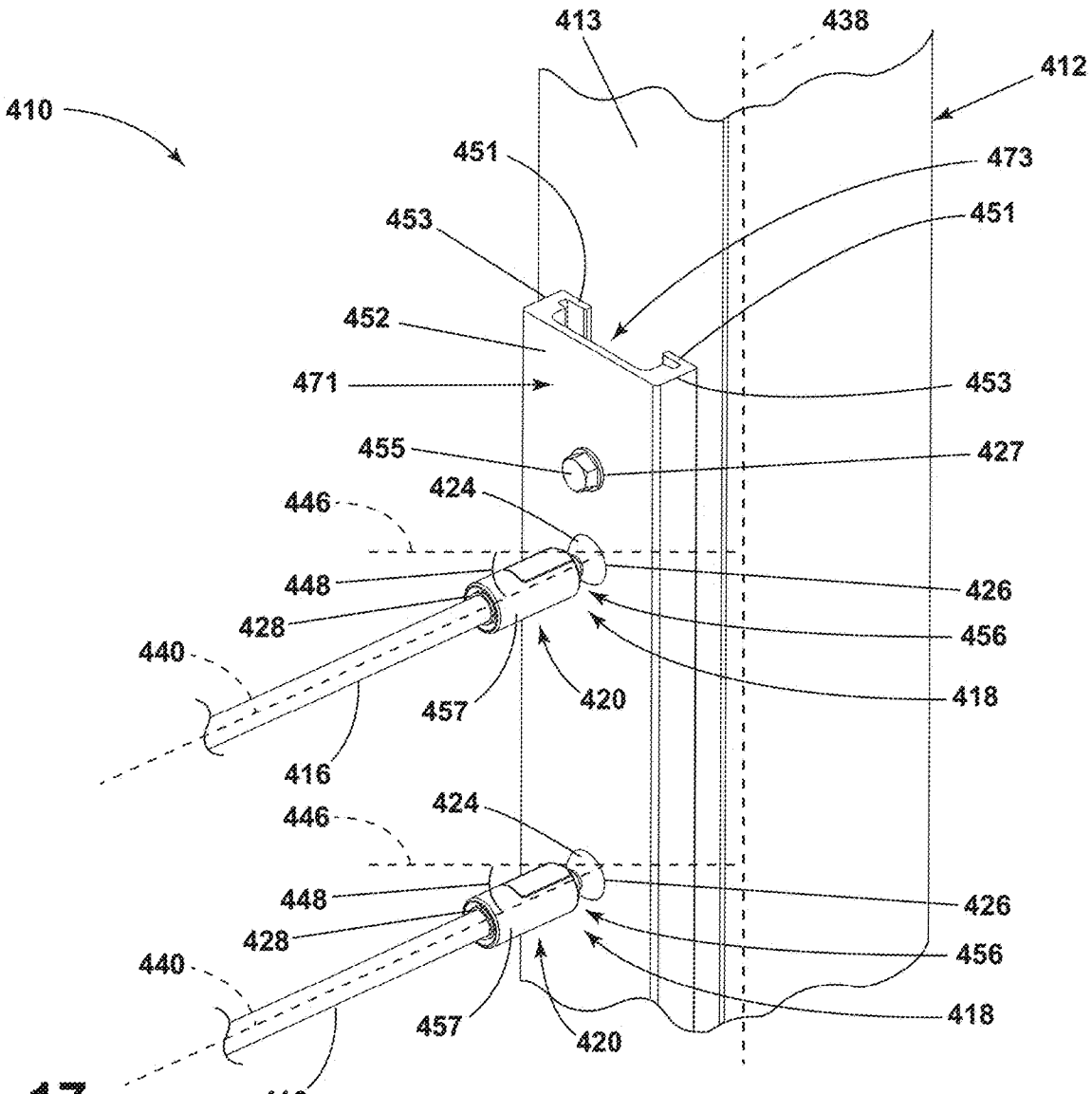
FIG. 17 is an enlarged and assembled perspective view of the portion of the railing system of FIG. 16, including the portion of the at least one rod and the at least one connector assembly.

FIG. 17 illustrates the assembled view of a portion of the at least one post 412 and the rods 416 by the connector assemblies 418 of the railing system 410. As illustrated, the connector assembly 418 is coupled to the post 412 by mounting of the plate 452 to the wall 413 by the at least one fastener 455. Each of the rods 416 extends along a rod centerline 440. An angle 448 is formed between the rod centerline 440 and a horizontal plane 446, which extends perpendicular from a centerline 438 of the at least one post 412 and intersects the rod centerline 440 to form the angle 448. The rod 416 and the threaded connector 420 are free to move relative to the plate 452 and the post 412 via free rotational movement of the ball 424 within the opening 426. In this way, the rod 416 and the threaded connector 420 do not have to move along a single plane of movement, but can instead move along multiple planes of movement, such as laterally, vertically, and diagonally with respect to the plate 452 and the wall 413 of the post 412. This, in turn, allows for an increased case of installation of the railing system 410 by accommodating differences in height and/or angle of various posts 412 and rods 416. The rod 416 is free to move radially and circumferentially with respect to the horizontal plane 446, with such radial and circumferential movement defining a dynamic installation of the rods 416.

Figure 18:
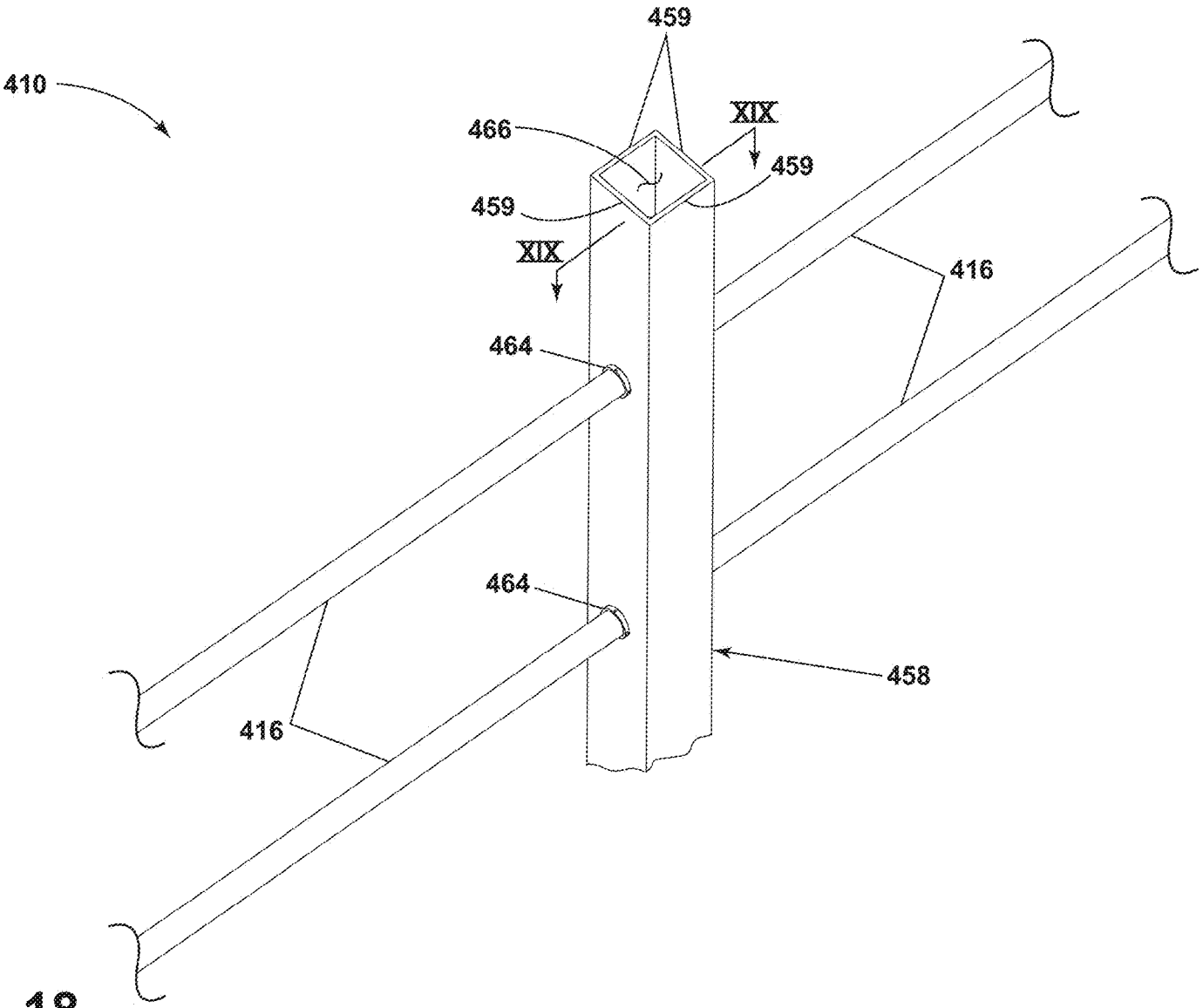
FIG. 18 is an enlarged perspective view of a portion of the railing system of FIG. 15, including another example of a support, according to another aspect of the present disclosure, and with the rail removed.

Turning now to FIG. 18, the support 458 is illustrated within a portion of the railing system 410, though it will be understood that the support 458 is also suitable for use with any of the other railing systems 10, 110, 210, 310 previously described. In one example, in the case that the railing system 410 includes the plurality of rods 416 extending between the two spaced apart posts 412, as shown in FIG. 15 and as described previously with respect to the railing systems 10, 110, 210, 310, it is contemplated that the support 458 can be positioned between the two posts 412, such as equidistantly between two of the posts 412. However, it will be understood that such spacing and positioning is not limiting and the support 458 can be spaced unevenly between two of the posts 412 or that more than one support 458 can be provided between two of the posts 412, whether evenly or unevenly spaced from one another along the rods 416.

While the support 358 included the first and second frame segments 360, 362, the support 458 is illustrated as being formed in a single piece, such that the support 458 comprises a unitary or monolithic structure having a plurality of walls 459. The support 458 is hollow, such that the support 458 defines an interior 466 formed by the walls 459. The support 458 further includes at least one frame opening 464. In the illustrated example, each of the frame openings 464 are defined within a single one of the walls 459. The support 458 can include any suitable number of frame openings 464, such as at least two frame openings 464. By way of non-limiting example, the total number of frame openings 464 of the support 458 can be twice the total number of rods 416 within the plurality of rods 416. Further by way of non-limiting example, it is contemplated that two opposing walls 459 of the support 458 can each include a respective frame opening 464, such that the support 458 defines at least one pair of opposing and generally vertically aligned frame openings 464 positioned at a vertical height on the support 458. The frame openings 464 are sized to accept, receive, or otherwise fit around a respective width or diameter of a corresponding portion of a respective rod 416. Thus, each rod 416 passes through a pair of two aligned frame openings 464, spaced apart from one another about the interior 466 on opposing walls 459 of the support 458, and passes through the interior 466. In other words, each rod 416 can pass through the support 458 via the frame openings 464.

Figure 19:
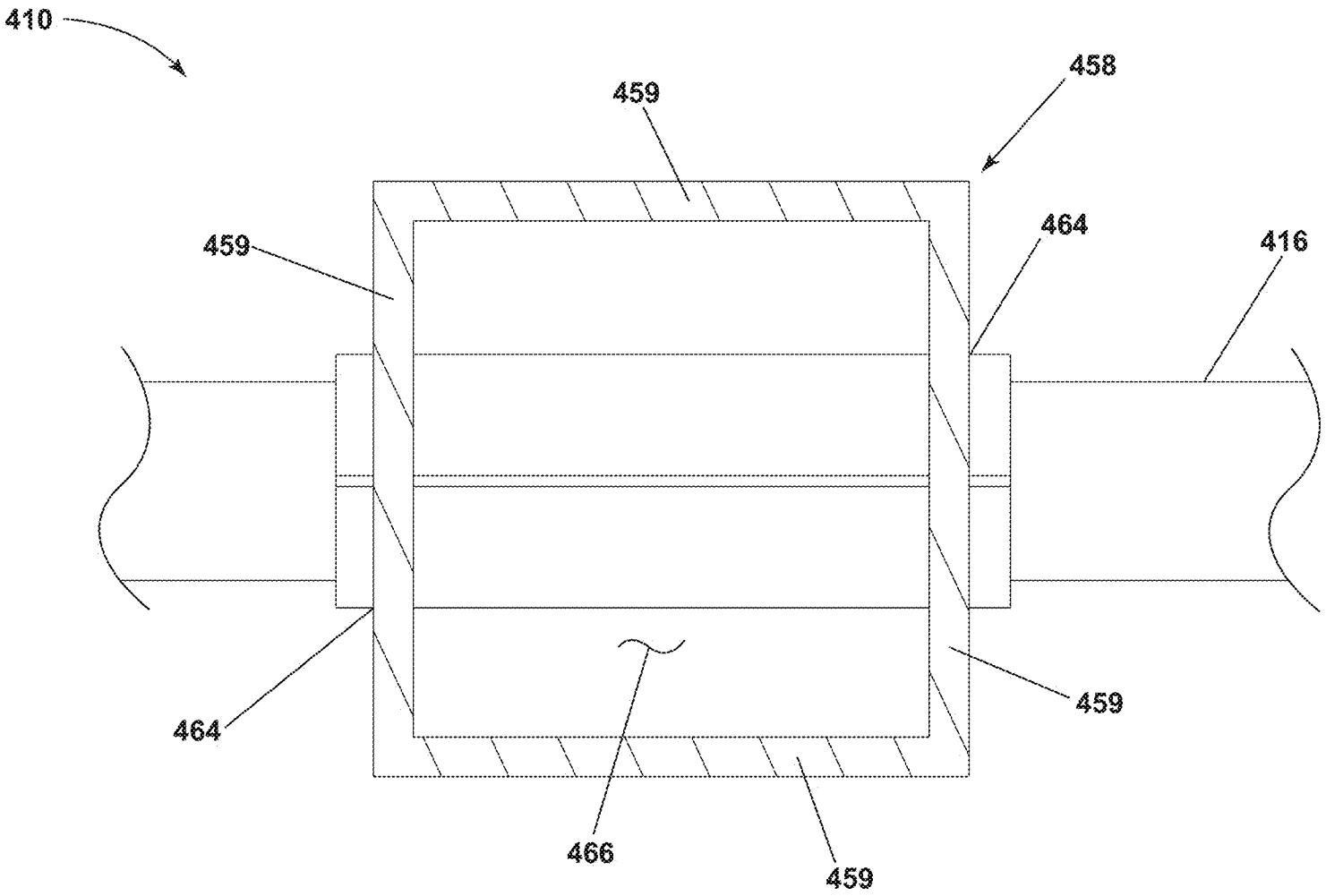
FIG. 19 is a top, cross-sectional view of a portion of the railing system of FIG. 15, including the support, taken along line XIX-XIX of FIG. 18.

Turning now to FIG. 19, the cross-sectional view illustrates a portion of the railing system 410, including the support 458 as seen from sight line XIX-XIX of FIG. 18, where it can be better seen that the walls 459 collectively form the single piece or monolithic support 458, without the need for the first and second frame segments 360, 362, hooks 368, and receivers 370 of the support 358. As illustrated, the rod 416 passes through the interior 466 of the support 458 through the frame openings 464 that are positioned at a midpoint of a width of the support 458. However, it will be understood that such positioning of the frame openings 464 is not limiting, and that the frame openings 464 can be provided at any suitable lateral position of the walls 459, including that the rod 416 can pass through the support 458 at an off-center position within the width of the support 458. During assembly of the railing system 410, each of the rods 416 can be fed through the support 458 via the frame openings 464 prior to attachment of the rods 416 to the posts 412. The support 458 can further be coupled to the upper rail 414 (FIG. 15) and/or to the ground or other mounting surface for the railing system 410, as described previously with respect to the support 358.

Figure 20:
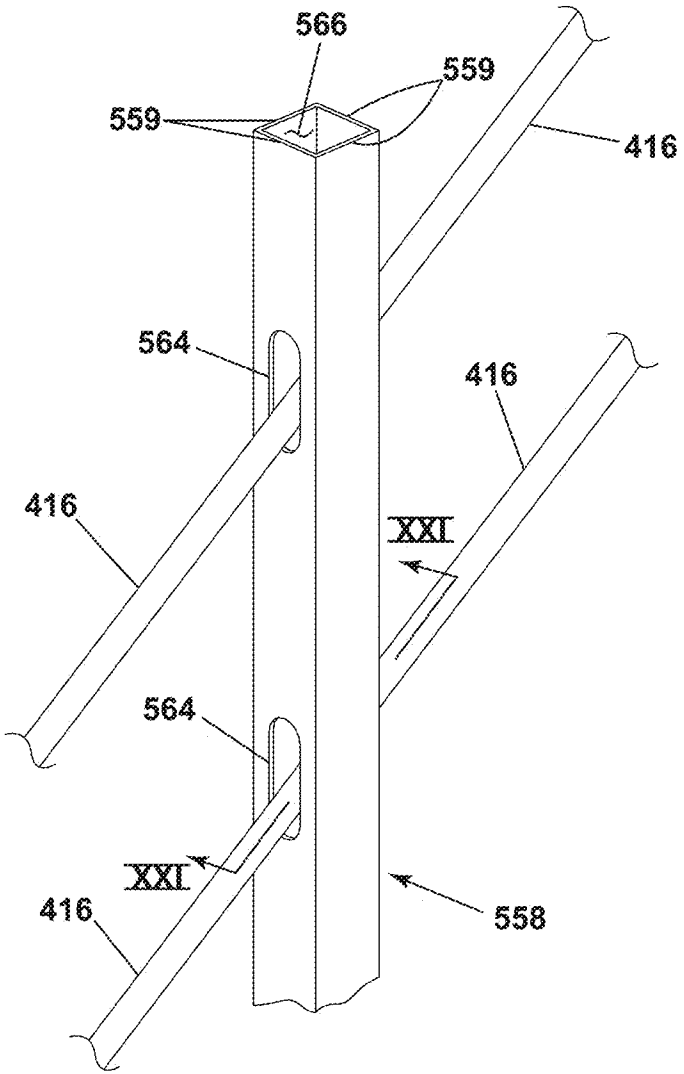
FIG. 20 is a front perspective view of a railing system similar to that of FIG. 15, including a portion of another exemplary support, according to another aspect of the present disclosure.

FIG. 20 is a perspective view of a portion of another example of a support 558, according to another aspect of the present disclosure, illustrated within a portion of the railing system 410, though it will be understood that the support 558 is also suitable for use with any of the other railing systems 10, 110, 210, 310 previously described. For case of description, the support 558 is similar to the supports 358, 458 as previously described, and, therefore, like parts will be identified with like numerals increased to the 500 series, with it being understood that the description of the like parts of the supports 358, 458 applies to the support 558, unless otherwise noted.

Like the support 458, the support 558 is illustrated as being formed in a single piece, such that the support 558 comprises a unitary or monolithic structure having a plurality of walls 559 and that is hollow, such that the support 558 defines an interior 566 formed by the walls 559. The support 558 further includes at least one frame opening 564, illustrated herein as a total number of frame openings 564 of the support 558 that is twice the total number of rods 416 within the plurality of rods 416, with each of the frame openings 564 defined within a single one of the walls 559. Further, in the illustrated and non-limiting example, two opposing walls 559 of the support 558 can each include a respective frame opening 564, such that the support 558 defines at least one pair of opposing and generally vertically aligned frame openings 564 positioned at a given vertical height on the support 558.

While the frame openings 464 of the support 458 were illustrated as having a size and shape generally complementary to and commensurate with a width, diameter, or cross-section of a corresponding portion of the respective rod 416, such as having a circular shape, the frame openings 564 of the support 558, as illustrated, have a size or shape that is larger than a width, diameter, or cross-section of a corresponding portion of the respective rod 416 in at least one dimension. By way of non-limiting example, the illustrated frame openings 564 are provided with an elongated or oblong shape, such as an oval, having a generally vertical height or extending along a portion of the height of the support 558 that is greater than a height, width, or diameter of the respective rod 416. By providing such elongated frame openings 564, the support 558 is thus able to accommodate rods 416 oriented in a non-horizontal position, such that the non-horizontal rods 416 pass through opposing frame openings 564 at different relative vertical positions within the frame openings 564. Thus, even when the railing system 410 is provided on a set of stairs or on an uneven support surface such that two opposing posts 412 are at least partially vertically offset from one another, each rod 416 passes through the pair of two aligned frame openings 564, spaced apart from one another about the interior 566 on opposing walls 559 of the support 558, at differing relative vertical positions within the height of the frame openings 564, such that each rod 416 passes through the support 558 and the interior 566 via the frame openings 564.

Figure 21:
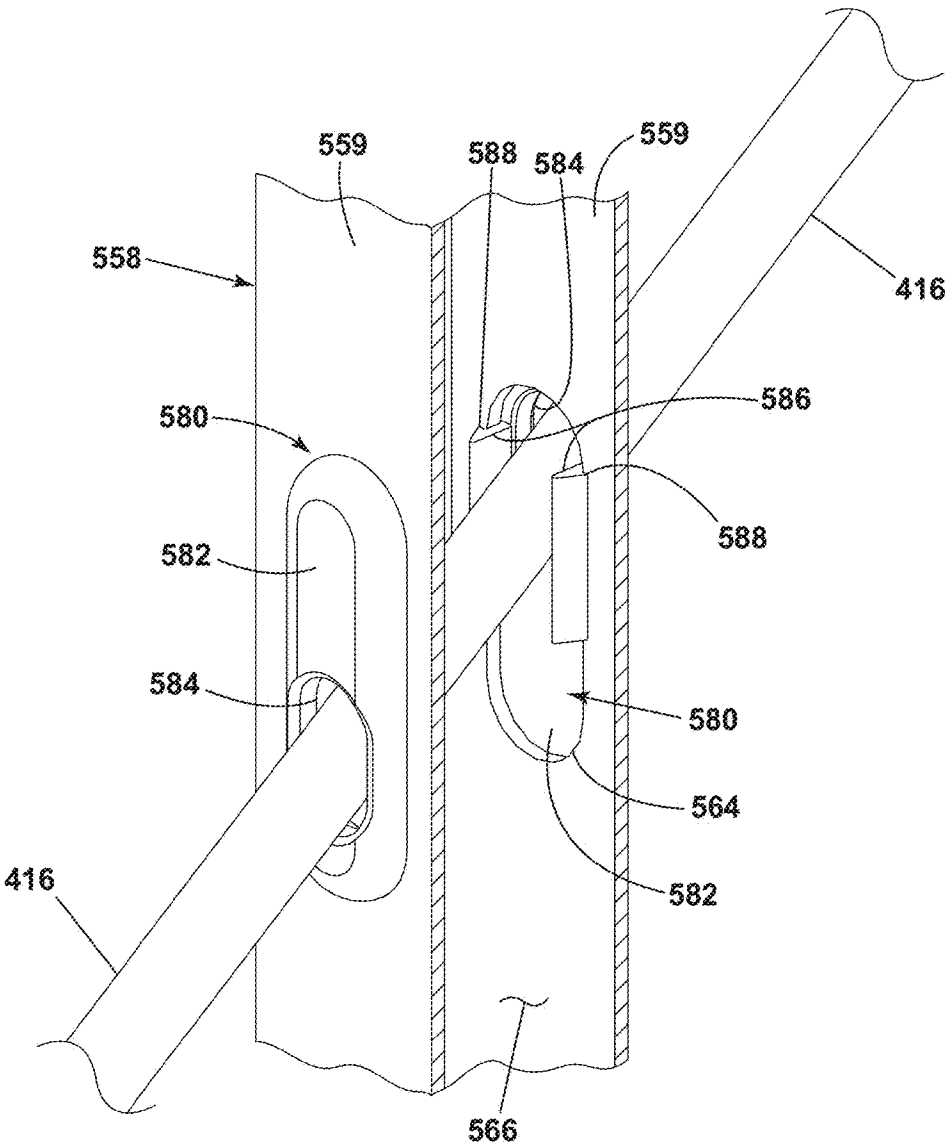
FIG. 21 is a front, cross-sectional view of a portion of the railing system of FIG. 20, including the support, having at least one grommet, according to another aspect of the present disclosure, and taken along line XXI-XXI of FIG. 20.

Turning now to FIG. 21, the front cross-sectional view illustrates a portion of the support 558, as seen from sight line XXI-XXI of FIG. 20, where it can be better seen that the angled or non-horizontally oriented rod 416 passes through the pair of two aligned and opposing frame openings 564, spaced apart from one another about the interior 566 on opposing walls 559 of the support 558, at differing relative vertical positions within the height of the frame openings 564. As illustrated, in this case, the angled rod 416 passes through one of the frame openings 564 generally at a lower portion of the one of the frame openings 564, while passing through the other of the frame openings 564 generally at an upper portion of the other of the frame openings 564.

Further optionally included and illustrated in FIG. 21 is at least one adjustable grommet 580, which can be included in the support 558. It will be understood that this is a non-limiting example providing one adjustable grommet 580 with each of the frame openings 564, though it will be understood that the adjustable grommet 580 may be provided with only one of the frame openings 564 out of each of the pairs of two aligned and opposing frame openings 564. Each adjustable grommet 580 comprises a face, illustrated herein as a grommet body 582, defining a grommet opening 584, such that the rod 416 can pass through the grommet body 582 via the grommet opening 584. By way of non-limiting example, the grommet body 582 can have a size and shape that is generally complementary to the size and shape of the frame opening 564, and further such that the grommet body 582 is commensurate in size with or larger than the frame opening 564. The grommet opening 584 is illustrated herein as having an elongated shape, similar to the shape of the frame opening 564 but proportionally smaller than the frame opening 564, though it will be understood that this is not limiting and that the grommet opening 584 can have any suitable size or shape such that the grommet openings 584 are sized to accept or otherwise fit around a respective portion of a corresponding portion of the respective rod 416.

Each of the adjustable grommets 580 further comprises at least one retaining leg 586, illustrated herein as a pair of spaced and opposing retaining legs 586 extending rearwardly from the grommet body 582. Each of the retaining legs 586 defines a flange, illustrated herein as a hooked end 588, spaced from the grommet body 582 along the retaining leg 586 and extending laterally outwardly from the retaining leg 586. Each of the adjustable grommets 580 is coupled with one of the frame openings 564, such that at least a portion of the adjustable grommet 580 extends through the frame opening 564 and into the interior 566, such as to retain or mount the adjustable grommet 580 at least partially within the frame opening 564. In the illustrated example, at least a portion of each of the retaining legs 586 extending rearwardly from the grommet body 582, toward the interior 566, extends through the frame opening 564 and into the interior 566, such that the hooked end 588 is positioned fully within the interior 566. Further, the hooked end 588 confronts and bears against the respective wall 559 along at least a portion of the frame opening 564 to frictionally retain the adjustable grommet 580 within the frame opening 564, such as through a snap fit.

By including the adjustable grommets 580 within the opposing pairs of frame openings 564, the adjustable grommets 580 enable the support 558 to accommodate rods 416 that are angled vertically within the support 558, as well as to accommodate rods 416 provided at a variety of angles relative to the support 558, in a number of ways. In a first, non-limiting example, the grommet openings 584 having an elongated shape and sized to be larger than the rod 416 can allow for the rod 416 to be angled or moved vertically within the grommet openings 584. In a further non-limiting example, the retaining legs 586 defining the hooked ends 588 can have a vertical height that is less than a vertical height of the frame opening 564, such that the retaining legs 586, and therefore also the grommet body 582, can be vertically slidable within the frame opening 564, providing further vertical adjustability to accommodate rods 416 provided at varying angles relative to the support 558.

Further yet, in another non-limiting example, the adjustable grommets 580 can be provided within the frame openings 564 at more than one orientation within the frame openings 564. For example, as illustrated, one of the adjustable grommets 580 is provided in a first orientation relative to the respective frame opening 564, such that the grommet opening 584 is positioned generally at a lower portion of one of the frame openings 564 of the opposing pair of frame openings 564, while an other of the adjustable grommets 580 is provided in a second orientation relative to the respective other of the frame openings 564, such that the grommet opening 584 of the adjustable grommet 580 in the second orientation is positioned generally at an upper portion of the other of the frame openings 564 of the opposing pair of frame openings 564. As illustrated, the second orientation can be thought of as an inverse or an inverted orientation relative to the first orientation, such that the adjustable grommet 580 in the second orientation is rotated 180 degrees in a vertical plane relative to the adjustable grommet 580 in the first orientation.

In this way, the positioning of the adjustable grommet 580 in either the first or second orientation allows the support 558 to accommodate rods 416 provided at various angles relative to the support 558, while the vertical slidability of the adjustable grommets 580 within the frame openings 564, and in either of the first or second orientations, provides accommodation for even further angling of the rods 416, and further yet while the vertical movement of the rod 416 within the grommet openings 584 provided accommodation for yet more angles or angling of the rods 416. Thus, the support 558 and the optional inclusion of the adjustable grommets 580 can be used to provide greater flexibility of the railing systems 10, 110, 210, 310, 410 for assembly on a wide variety of support surfaces having various topographies, and in such a way that accommodates angled rods 416 by mechanisms of adjustment that are simple and easily adjusted by a user.

Benefits of the present disclosure include a more robust design that can fit into a variety of railing systems when compared to a conventional railing system. For example, the conventional railing system relies on static connections that connect the rods to a respective portion of the posts. These static connections cannot be moved once connected to the post. As such, the rod cannot be moved along a plane of movement after being connected to the post through the connector. As such, the user installing the conventional railing system must carefully and precisely measure and position each rod based on the location and relative positioning of the two posts to ensure that each rod properly extends between each post. The railing system as described herein, however, uses a connector, as well as optionally supports and adjustable grommets, that allows for at least one plane of movement of the rod after it has been connected to one of the posts. This degree of movement or dynamic installation allows for the user installing the railing system to move the rod around after it has been installed to one of the posts to ensure that it extends at the correct or desired angle from the post such that it can be coupled to the other post. This, in turn, results in a very robust system that has a much decreased burden of installation when compared to the conventional railing system.

Cable type railings are popular due to the minimal view obstruction, but can be costly and difficult to install. The disclosed aspects aim to provide railing systems that are user- or do-it-yourself-friendly and provide minimal view obstructions, and also at a much lower cost when compared to professionally installed options. The disclosed aspects also eliminate complex baluster, post, or rod attachment points by creating a universal hardware that works for both stairs and horizontal angles. Aspects of the present disclosure also allow for swiveling of each ball joint to create angles of the rods relative to the posts, as well as relative to the supports, that can accommodate both stair rails and horizontal angles.

It will also be understood that various changes and/or modifications can be made without departing from the spirit of the present disclosure. By way of non-limiting example, although the present disclosure is described for use with a railing system including a plurality of vertically spaced rods, it will be recognized that the various connector assemblies described herein can be employed with various railing constructions or configurations, including, but not limited to, that such connector assemblies can be used with railing systems having upper and lower rails connected to posts by the connector assemblies, with vertical balusters, rather than horizontal rods.

To the extent not already described, the different features and structures of the various aspects can be used in combination with each other as desired to form a suitable railing assembly. That one feature is not illustrated in all of the aspects is not meant to be construed that it cannot be, but is done for brevity of description. Thus, the various features of the different aspects can be mixed and matched as desired to form new aspects, whether or not the new aspects are expressly described. All combinations or permutations of features described herein are covered by this disclosure. For example, it will be understood that any of the connector assemblies 18, 118, 218, 418 can be provided with various features, structures, or configurations or any of the railing systems 10, 110, 210, 310, 410, and that any of the supports 358, 458, 558 can also be provided in combination with any of the connector assemblies 18, 118, 218, 418 and/or with any of the railing systems 10, 110, 210, 310, 410.

For example, various characteristics, aspects, and advantages of the present disclosure may also be embodied in the following technical solutions defined by the following clauses and may include any combination of the following concepts:

A railing system comprising at least one post, at least one rod defining a first distal end and a second distal end, and at least one connector assembly operably coupling one of the first distal end or the second distal end of the at least one rod to the at least one post, wherein the at least one connector assembly is configured for movably coupling the at least one rod to the at least one post such that the at least one rod is pivotable relative to the at least one post in at least one plane of movement.

The railing system of any preceding clause, wherein the at least one post comprises at least a first post and a second post, the second post spaced apart from the first post, the at least one rod extending between the first post and the second post.

The railing system of any preceding clause, wherein the at least one connector assembly comprises at least a first connector assembly movably coupling the one of the first distal end or the second distal end to the first post and a second connector assembly movably coupling the other of the first distal end or the second distal end to the second post.

The railing system of any preceding clause, wherein the at least one connector assembly is configured for movably coupling the at least one rod to the at least one post such that the at least one rod is pivotable relative to the at least one post in multiple planes of movement.

The railing system of any preceding clause, wherein the at least one connector assembly is configured for movably coupling the at least one rod to the at least one post such that the at least one rod is pivotable relative to the at least one post in at least a vertical plane of movement and a horizontal plane of movement.

The railing system of any preceding clause, further comprising a rail extending perpendicularly from the at least one post.

The railing system of any preceding clause, further comprising at least one support coupled to the at least one rod, the at least one support spaced from and extending generally parallel to the at least one post.

The railing system of any preceding clause, wherein the at least one support is further coupled to at least one of the rail and a support surface upon which the railing system is assembled.

The railing system of any preceding clause, wherein the at least one connector assembly comprises a ball coupled to the one of the first distal end or the second distal end of the at least one rod, and a seat coupled to the at least one post and adapted to at least partially retain and pivotably receive the ball within the seat, wherein pivotal movement of the ball within the seat operably couples the at least one rod for pivotable movement relative to the at least one post in the at least one plane of movement.

The railing system of any preceding clause, wherein the at least one connector assembly further comprises a socket at least partially defining the seat and a channel, the socket coupled to a wall of the at least one post such that the seat extends through the wall into an interior of the at least one post.

The railing system of any preceding clause, wherein at least a portion of the ball is positioned within the interior of the at least one post when the ball is retained within the seat, and further wherein at least a portion of the at least one connector assembly extends through the channel such that the orientation of the channel relative to the at least one post defines the plane of movement within which the at least one rod is pivotable relative to the at least one post.

The railing system of any preceding clause, wherein the connector assembly further comprises a plate received within a channel formed within a wall of the at least one post, the plate defining an opening forming at least a portion of the seat, wherein at least a portion of the ball is positioned within an interior of the at least one post when the ball is retained within the opening.

The railing system of any preceding clause, wherein the connector assembly further comprises a plate coupled to and protruding outwardly from a wall of the at least one post, the plate defining at least one opening forming at least a portion of the seat, wherein at least a portion of the ball is positioned behind the plate when the ball is retained within the opening.

A connector assembly for operably coupling a rod to a post within a railing system, the connector assembly comprising a ball coupled to an end of the rod, and a seat coupled to the post and adapted to at least partially retain and rotatably or pivotably receive the ball within the seat, wherein rotational or pivotal movement of the ball within the seat operably couples the rod for rotatable or pivotable movement relative to the post in at least one plane of movement.

The connector assembly of any preceding clause, wherein at least a portion of the ball is positioned within an interior of the post when the ball is retained within the seat.

The connector assembly of any preceding clause, further comprising a socket at least partially defining the seat and a channel, the socket coupled to a wall of the post such that the seat extends through the wall into an interior of the post.

The connector assembly of any preceding clause, wherein at least a portion of the ball is positioned within the interior of the post when the ball is retained within the seat, and further wherein at least a portion of the connector assembly extends through the channel such that the orientation of the channel relative to the post defines the plane of movement within which the rod is rotatable or pivotable relative to the post.

The connector assembly of any preceding clause, further comprising a plate received within a channel formed within a wall of the post, the plate defining an opening forming at least a portion of the seat, wherein at least a portion of the ball is positioned within an interior of the post when the ball is retained within the opening.

The connector assembly of any preceding clause, wherein the plate further defines at least one notch formed along a portion of the opening.

The connector assembly of any preceding clause, further comprising a plate coupled to and protruding outwardly from a wall of the post, the plate defining at least one opening forming at least a portion of the seat, wherein at least a portion of the ball is positioned behind the plate when the ball is retained within the opening.

A method of assembling a railing system having at least one post and at least one rod, the method of assembling the railing system comprising threadably coupling a ball to an end of the at least one rod, coupling a seat to a wall of the at least one post, and rotatably receiving the ball within the seat such that the ball is at least partially retained within the seat, wherein rotational movement of the ball within the seat operably couples the at least one rod for rotatable movement relative to the at least one post in at least one plane of movement.

The method of assembling a railing system of any preceding clause, wherein the coupling the seat to the wall of the at least one post comprises coupling a plate to the wall of the at least one post, the plate defining at least one opening forming at least a portion of the seat.

The method of assembling a railing system of any preceding clause, further comprising passing the at least one rod through at least one support spaced from and extending generally parallel to the at least one post.

The method of assembling a railing system of any preceding clause, wherein the passing the at least one rod through the at least one support occurs prior to rotatably receiving the ball within the seat.

The method of assembling a railing system of any preceding clause, wherein the passing the at least one rod through the at least one support further comprises aligning a first frame segment of the at least one support with a second frame segment of the at least one support, aligning the at least one rod with at least one frame opening defined by a portion of the first frame segment and a corresponding portion of the second frame segment, and coupling the first frame segment to the second frame segment to form the support.

While aspects of the present disclosure have been specifically described in connection with certain specific aspects thereof, it is to be understood that this is by way of illustration and not of limitation. Reasonable variation and modification are possible with the scope of the foregoing disclosure and drawings without departing from the spirit of the present disclosure, which is defined in the appended claims. Hence, specific dimensions and other physical characteristics relating to the aspects disclosed herein are not to be considered as limiting, unless the claims expressly state otherwise.

What is claimed is:

1. A railing system comprising:

a post assembly including a post having multiple sides, at least one of the multiple sides having an outer face and a channel or opening provided thereon and a plate configured to be received within the channel or opening, wherein the plate is longitudinally slidingly received within the channel or the opening of the outer face of the post;

an infill defining a first distal end; and a connector assembly operably coupling the first distal end of the infill to the plate and wherein the connector assembly comprises:

a ball, wherein the ball is substantially disposed on a first side of the plate; and a connector on a second side of the plate, the second side opposite the first side and wherein when assembled the connector is located between the ball and first distal end of the infill.

2. The railing system of claim 1, wherein the connector is directly coupled to the first distal end of the infill and the ball.

3. The railing system of claim 1, wherein the plate is a contoured plate.

4. The railing system of claim 3, wherein the contoured plate has lip portions and the lip portions are received within a portion of the post.

5. The railing system of claim 1, wherein the outer face includes an outer face first portion having a first interior edge and an outer face second portion having a second interior edge spaced from the first interior edge by the channel or opening.

6. The railing system of claim 5, wherein the outer face first portion, the outer face second portion, and a portion of the plate between the first interior edge and the second interior edge are flush.

7. The railing system of claim 1, wherein at least a portion of the post is a hollow portion and the ball is received within the hollow portion.

8. The railing system of claim 1, wherein when the plate is received within the channel or opening the plate defines a first side and a second side that is opposite the first side and wherein when the plate is received within the channel or opening the second side is facing outward.

9. The railing system of claim 8, wherein the plate includes at least one opening and at least a portion of the connector assembly is inserted through the at least one opening such that at least a portion of the ball rests on the first side of the plate within the at least one opening.

10. The railing system of claim 9, wherein another of the multiple sides has a second outer face having a second channel or second opening provided thereon and a second plate configured to be received within the second channel or the second opening and wherein the second plate is free of openings.

11. The railing system of claim 1, wherein a curved portion of the ball is seated within the at least one opening and is configured for a horizontal infill installation and for an angled infill installation.

12. The railing system of claim 1, wherein the ball is pivotably received at least one opening such that the infill is pivotable with respect to the post assembly in multiple planes of movement.

13. The railing system of claim 1, wherein the infill is a cable or a rod.

14. The railing system of claim 1, wherein the plate includes multiple openings.

15. A connector assembly for use with a post of a railing system, wherein the post has multiple sides, at least one of the multiple sides having an outer face and a channel or an opening provided thereon, the connector assembly comprising:

a plate configured to be longitudinally slidingly received within the channel or opening of the outer face of the post, the plate defining a first side and a second side that is opposite the first side, at least one other opening extending from the first side to the second side of the plate, the at least one other opening forming a seat;

a ball substantially disposed on the first side of the plate and configured to be received within the seat; and a connector on the second side of the plate, the connector operably coupling the ball and a piece of infill of the railing system.

16. The connector assembly of claim 15, wherein the connector is threadedly coupled to the ball.

17. The connector assembly of claim 15, wherein when assembled the ball is pivotable within the seat about multiple planes of movement.

18. The connector assembly of claim 15, wherein the plate is a contoured plate.

19. The connector assembly of claim 15, wherein the plate includes a flat portion with a first lip extending from a first edge and a second lip extending from a second edge.

* * * * *